US006542128B1

(12) United States Patent
Johnson et al.

(10) Patent No.: US 6,542,128 B1
(45) Date of Patent: Apr. 1, 2003

(54) WIDE BEAMWIDTH ULTRA-COMPACT ANTENNA WITH MULTIPLE POLARIZATION

(75) Inventors: Gregory F. Johnson, Aptos, CA (US); Arthur O. Snow, Boulder Creek, CA (US)

(73) Assignee: Tyco Electronics Logistics AG (CH)

( * ) Notice: Subject to any disclaimer, the term of this patent is extended or adjusted under 35 U.S.C. 154(b) by 58 days.

(21) Appl. No.: 09/785,145

(22) Filed: Feb. 16, 2001

Related U.S. Application Data

(60) Provisional application No. 60/193,561, filed on Mar. 31, 2000, and provisional application No. 60/213,078, filed on Jun. 20, 2000.

(51) Int. Cl.[7] ..... H01Q 11/12

(52) U.S. Cl. ..... 343/742; 343/826; 343/867

(58) Field of Search ..... 343/700 MS, 742, 343/797, 826, 829, 846, 848, 849, 855, 867; H01Q 11/12

(56) References Cited

U.S. PATENT DOCUMENTS 2,787,788 A * 4/1957 Clough ..... 343/742
3,680,135 A * 7/1972 Boyer ..... 343/742
5,592,182 A * 1/1997 Yao et al. ..... 343/742
5,654,724 A * 8/1997 Chu ..... 343/742
5,784,032 A * 7/1998 Johnston et al. ..... 343/702
6,014,107 A * 1/2000 Wiesenfarth ..... 343/742

* cited by examiner

*Primary Examiner*—Tho Phan
(74) *Attorney, Agent, or Firm*—Fulbright & Jaworski L.L.P.

(57) ABSTRACT

In a first aspect, an antenna for use at a particular frequency or in a frequency band including said particular frequency, comprises a conductive ground plane having a length in at least one dimension of about a quarter wavelength at said particular frequency or more, and first and second crossed conductive driven elements arrayed over at least a portion of said ground plane, wherein the elements in the region in which they cross are spaced apart so as to avoid electrical contact and any substantial capacitive coupling to each other, each element is about a quarter wavelength electrically at said particular frequency, each element has at least one end portion generally perpendicular to said ground plane and at least one further portion, said elements and ground plane generally defining a volume, at least one end of each driven element is electrically coupled to said ground plane, and the elements are fed ninety degrees out of phase with respect to each other. In a second aspect, an antenna component, comprises a conductive antenna element, a capacitor electrically coupled to said element, the capacitor having plates and a dielectric between the plates, wherein at least one of the plates of said capacitor comprises at least a portion of at least a segment of said conductive antenna element, and a conductive member, at least a portion thereof comprising at least one other plate of said capacitor, wherein the capacitor dielectric includes at least in part a moldable dielectric shaped to hold the plates of the capacitor with respect to each other.

39 Claims, 25 Drawing Sheets

WIDE BEAMWIDTH ULTRA-COMPACT ANTENNA WITH MULTIPLE POLARIZATION

CROSS-REFERENCE TO RELATED APPLICATIONS

This application claims priority of U.S. Provisional Patent Application Ser. No. 60/193,561 of Gregory F. Johnson, filed Mar. 31, 2000 and U.S. Provisional Patent Application Ser. No. 60/213,078 of Gregory F. Johnson, filed June 20, 2000.

FIELD OF THE INVENTION

In a first aspect, the invention relates to antennas for hand-held, portable, mobile, marine, or fixed wireless communications devices (WCD's), including, for example, hand-held, notebook, or desktop computers, cellular telephones, data devices, communications transceivers, global positioning satellite (GPS) receivers, and vehicular digital radios. In particular, a first aspect of the invention relates to an antenna which includes two crossed driven elements in proximity to a ground plane arranged so as to exhibit dual-linear and circular (or elliptical) polarizations simultaneously and provide at least a substantially hemispherical antenna pattern. In compact embodiments, the antenna easily fits inside the plastic housing of a WCD, thereby providing mechanical robustness. The antennas according to the present invention may be used for transmitting, receiving, or for transmitting and receiving.

In a second aspect, the invention relates to precision capacitors for use in antennas of the type that form the first aspect of the invention and for use in other types of antennas.

SUMMARY OF THE INVENTION

In its first aspect, the present invention relates to antennas that include a conductive ground plane with two bent quarter-wave (electrically) crossed driven elements fed ninety degrees out of phase arrayed over at least a portion of it. Each driven element is electrically substantially a quarter wavelength at or near a desired operating frequency or within a desired operating frequency band. Each driven element preferably has generally a U-shape, having bent-over end portions generally perpendicular to the ground plane and a central portion generally parallel to the ground plane. At least one end of each element is electrically coupled to the ground plane (directly or through a resonating capacitor that allows the element to be electrically a quarter wavelength but physically less than a quarter wavelength). The central portions cross at about ninety degrees without touching and without being so close as to substantially capacitively couple to each other. The parallel portions of the driven elements are closely spaced to the ground plane. The driven elements may be directly end fed or shunt fed, in each case with or without a matching network. In practical embodiments of the U-shaped configuration, operating bandwidths of approximately two to ten percent can be achieved.

Alternatively, and less desirably (because the antenna's patterns are degraded relative to those resulting from U-shaped driven elements), each driven element may have a single vertical portion and a portion that slopes from the top of the vertical portion to toward the ground plane, thus having an overall L-shape (but with an angle of less than ninety degrees). Either the end of the single vertical portion or the other end is electrically coupled to the ground plane (directly or through a resonating capacitor). The other end may be directly end fed or electrically coupled to the ground plane and shunt fed.

The overall length and height above the ground plane of the two driven elements may be varied simultaneously to vary gain, with longer length and greater heights producing higher gain. A dielectric, with a dielectric constant greater than one, may be located inside the volume or "cage" formed by the crossed elements to reduce the height of the elements above the ground plane. In some embodiments of the first aspect of the invention, a molded dielectric is located within the crossed elements. The dielectric may be plastic or some other moldable material having suitable dielectric characteristics such as fiberglass or a ceramic material.

In the U-shaped driven element configuration, the portions of the driven elements perpendicular to the ground plane cause a linear polarization, and the portions parallel to the ground plane cause circular or elliptical polarization. A further linear polarization is caused by the major dimension of the ground plane. Useful radiation is exhibited at either a linear or a circular (or elliptical) polarization in substantially a hemisphere over the side of the ground plane over which the driven elements are arrayed. Configurations employing the modified L-shaped driven elements will exhibit polarizations similar to those just mentioned, but somewhat degraded.

The circular (or elliptical) polarization, when it is right-handed circular polarization (RHCP), is particularly useful for receiving RHCP signals from GPS satellites. The orientation of the ground plane with respect to the zenith is not critical for this application, which makes the antenna of this invention particularly useful when, for example, it is mounted near the top of a WCD such as a cellular telephone that may be held by the user in a variety of positions. In practical embodiments, the antenna of this invention, when optimally oriented and connected to a GPS receiver, can provide lock-on to the GPS system in a time comparable to a quadrifilar helix, which typically is a much larger antenna.

To provide a compact realization of an antenna according to the first aspect of the invention, a capacitor may be provided at the end of the element or within the element to series resonate the element to a desired frequency and reduce its physical length. A driven element thus can be reduced to much less than a physical quarter wavelength. In order to provide substantial resonance within a desired range of frequencies, the capacitance must be set and maintained within a predetermined range with a high degree of accuracy. Each "resonating" or "tuning" capacitor may be located between the end of the element and the ground plane (this location is easier to implement and is shown herein in the exemplary embodiments) or, alternatively, each may be located in series along the element within about the half of the element closest to the second end of the driven element such that it splits the element into segments, a segment between its first end and the capacitor and the segment between the capacitor and its second end.

The second aspect of the present invention relates to precision capacitors that are particularly useful in antennas according to the first aspect of the invention and also for use in other antennas, including, but not limited to, physically-shortened single element bent quarter-wave antennas. Off-the-shelf capacitors and capacitors employing PWB dielectrics generally are not satisfactory for one or more reasons: they may not provide the required tolerance and precision (for example, the thickness of PWBs varies, the capacitance may vary with temperature), they may not be available in the required capacitance value, and they may not be available with the required tolerance. Typically, off-the-shelf chip capacitors are available with values starting at about 0.1 pf (picofarads) in increments of 0.1 pf with tolerances of about plus/minus 0.1 pf. In this application, non-standard capacitance values are required with tolerances of about plus/minus 0.05 pf to assure continued resonance of a shortened driven element within a desired frequency band during normal operation.

BRIEF DESCRIPTION OF THE DRAWINGS

FIG. 1, is to scale.

DESCRIPTION OF THE PREFERRED EMBODIMENTS

Figure 1:
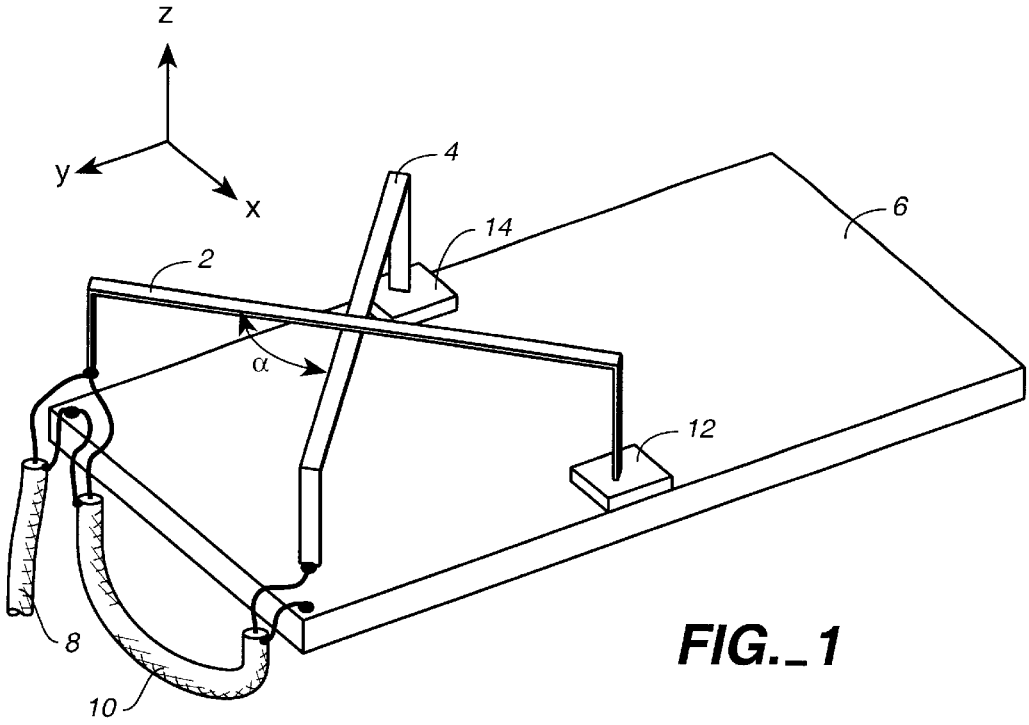
FIG. 1 is an idealized perspective view of one embodiment of an antenna according to a first aspect of the invention. None of the figures, including

Referring to FIG. 1, a perspective view of an embodiment of an idealized antenna according to the first aspect of the invention is shown. A first driven antenna element 2 is located so that it crosses at an angle with respect to a second driven antenna element 4. Although shown in FIG. 1 as flat ribbon-like elements having a rectangular cross-section, the shape of the elements is not critical. For example, the element cross-section may be cylindrical (as shown in FIGS. 3B, 3C, 4B and 4C). The elements may be metal, a conductively plated dielectric material (such as plastic) or a conductively painted dielectric. These and other conductive elements described herein may be formed by extrusion, stamping, casting, machining, or selective plating, for example. Elements 2 and 4 are arrayed over a conductive ground plane 6 that is generally planar at least in the region of the crossed driven elements. At least one major dimension of ground plane 6 is about a quarter wavelength or more at a desired operating frequency or within a desired range of operating frequencies. Ground plane 6 is an integral portion of the antenna and also forms a mechanical support for the antenna. The spatial orientation of the antenna is shown —the X and Y directions lie in the ground plane, while direction Z is perpendicular to it. The rectangular shape of ground plane 6 is not critical. The two crossed driven elements are fed substantially ninety-degrees out of phase. The driven elements may be directly end fed, as shown, or may be shunt fed (as shown in other embodiments, described below). Impedance matching (not shown) may be employed in either case (although, in most cases, when shunt feeding is employed, a desired impedance match can be obtained without further matching merely by selecting an appropriate feed point). Preferably, each driven element has generally a U-shape, having bent-over end portions that are generally perpendicular to the ground plane and a central portion generally parallel to the ground plane. Preferably, the central portions cross at an angle of about ninety degrees. The elements do not touch and are spaced apart sufficiently so that there is substantially no capacitive coupling. The parallel portions of the driven elements are closely spaced to the ground plane, preferably less than a tenth of a wavelength at the desired operating frequency but more than about four one hundredths of a wavelength.

In the idealized view of FIG. 1, the fed ends of the driven elements are shown spaced away from the ground plane 6 with no mechanical support. In a practical embodiment, suitable insulators can be used to support the fed ends for mechanical stability. For direct feed, the center conductor of a feedline 8 from a transmitter, receiver or transceiver can be connected directly to a first end of element 4 and the outer shield of the coaxial feedline can be connected to a nearby location on the ground plane 6. A section of coaxial feedline 10 having an electrical length of about one-quarter wavelength at or near the desired operating frequency of the antenna is connected between the first end of element 2 and the first end of element 4 (i.e., the center conductor at each end of the line 10 is connected to a respective element and its outer shield at each end is connected to a location near the element feed point on the ground plane 6). The quarter-wave feedline section 10 acts as a phasing line so that one element is fed nominally ninety-degrees out of phase with respect to the other. In a practical embodiment, the coaxial feedlines may have a nominal impedance of 50 ohms. Thus, if the fed endpoint of element 2 is 50 ohms, feedline 8 will see an impedance of 25 ohms (resulting from the 50 ohm fed endpoint and the quarter wave feedline section 10 in parallel) and will require a suitable matching arrangement (not shown), as is well known in the art.

The second ends of the driven elements 2 and 4 can be directly connected to the ground plane 6 or connected to the ground plane 6 through respective capacitors 12 and 14 as shown. Capacitors allow the driven elements to be resonated at a particular frequency when a physically shorter element is employed than would be required for resonance without the capacitors (some shortening also is provided by the element to ground capacitance, which is distributed along the element). As explained above, each "resonating" or "tuning" capacitor may be located between the end of the element and the ground plane or, alternatively, each may be located in series in the element within about the half of the element closest to the second end of the driven element.

Ground plane 6 may be a continuous sheet conductor dedicated to use in the antenna or it may also perform one or more other functions. Alternatively, the ground plane 6 need not be a continuous conductor but may be discontinuous, such as the ground traces of a printed wiring board (PWB). In the latter case, the driven elements may be located over components affixed to the PWB. Although its shape is not critical, as mentioned above, in practical embodiments, the ground plane may be rectangular in its major dimensions as shown. Although the ground plane 6 should be generally planar in the region of the driven elements arrayed over it, the remainder of the ground plane may be non-planar. This may occur, for example, in the case of a PWB ground plane that is curved to fit within a WCD.

The antenna is particularly adaptable to a compact realization using series resonating capacitors in each element leg. In such case, a preferred length for the perpendicular end sections of the elements is about 0.06 wavelength each, with a usable range of lengths from about 0.02 to 0.08 wavelengths each and a preferred length for the central parallel portion of about 0.09 wavelength, with a range of about 0.06 to 0.18 wavelengths, resulting in an overall physical driven element length of less than 0.25 wavelengths. The respective lengths are not critical when, as explained further below, a capacitor between one end of the driven element and the ground plane 6 is used to resonate the driven element. The length of elements 2 and 4 may be proportionally decreased with some decrease in gain. The driven elements may have a cylindrical, rectangular or other cross-section. The surface area of the driven elements may be increased to provide wider bandwidth.

While, in practice, the driven elements are substantially identical to each other physically, their lengths or other characteristics may vary somewhat provided that their differences do not result in more than small differences (say within plus or minus ten percent) in power division between the two elements.

Figure 2A:
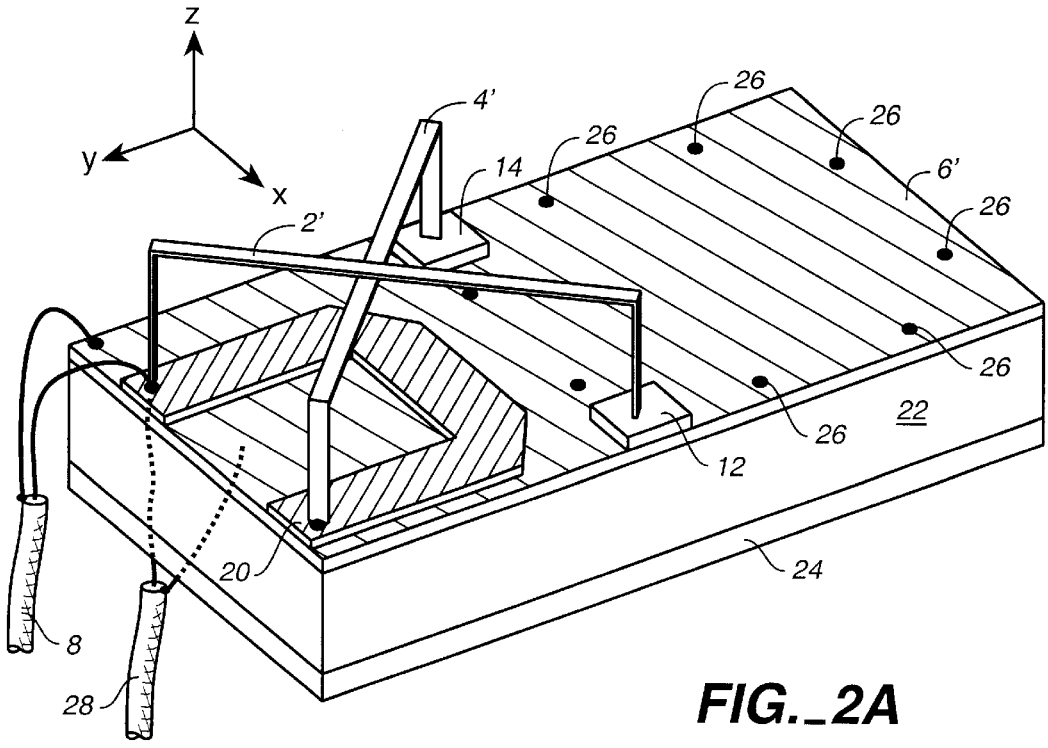
FIG. 2A is an idealized perspective view of an alternative embodiment of an antenna according to a first aspect of the invention.

Referring now to FIG. 2A, a perspective view of another embodiment of an idealized antenna according to the first aspect of the invention is shown. This embodiment is a variation of the embodiment of FIG. 1 in that the nominally quarter-wave phasing line is a low impedance microstrip line 20 instead of a coaxial line, and the ground plane is a conductor 6' on one side of a printed circuit board (PCB) consisting of a dielectric 22 having top and bottom conductive sides (6' and 24, respectively). A multiplicity of vias (conductive feedthroughs) 26 electrically connect the upper and low conductors of the PCB. The microstrip line 20 consists of a conductive surface separated from the ground plane 6' by a dielectric. The fed ends of the antenna elements 2' and 4' may be mechanically and electrically connected directly to the microstrip line 20 as shown in FIG. 2A (as, for example, by solder). Elements 2' and 4' are other-wise the same as elements 2 and 4 of the FIG. 1 embodiment. The line 20 has a serpentine or meandering shape to conserve space. The meandering configuration is not critical. The coaxial feedline 8 has its center conductor connected to a point at or near where the fed end of element 2' is connected to the microstrip line 20. The outer shield of coaxial cable 8 preferably is connected to the top conductor 6' of the PCB, as shown. The distal ends of elements 2' and 4' are coupled to the ground plane 6' through capacitors 12 and 14, respectively, in the manner of the FIG. 1 embodiment. ). As explained above, each "resonating" or "tuning" capacitor may be located between the end of the element and the ground plane or, alternatively, each may be located in series in the element within about the half of the element closest to the second end of the driven element. As an alternative to the coaxial feedline 8, a coaxial feedline 28 may be provided that passes, without electrical connection, through conductive surface 24 and dielectric 22 so that its outer shield is connected to the bottom of the conductive top surface 6' and its center conductor passes through the conductive bottom surface 24 and the top surface 6', without contacting either, and through the dielectric of microstrip 30 to the conductive surface of the microstrip.

Throughout this document, the same reference numerals will be assigned to the same or similar elements. Modified, but analogous elements, are designated by adding one or more prime (') symbols to the original numeral.

Figure 2B:
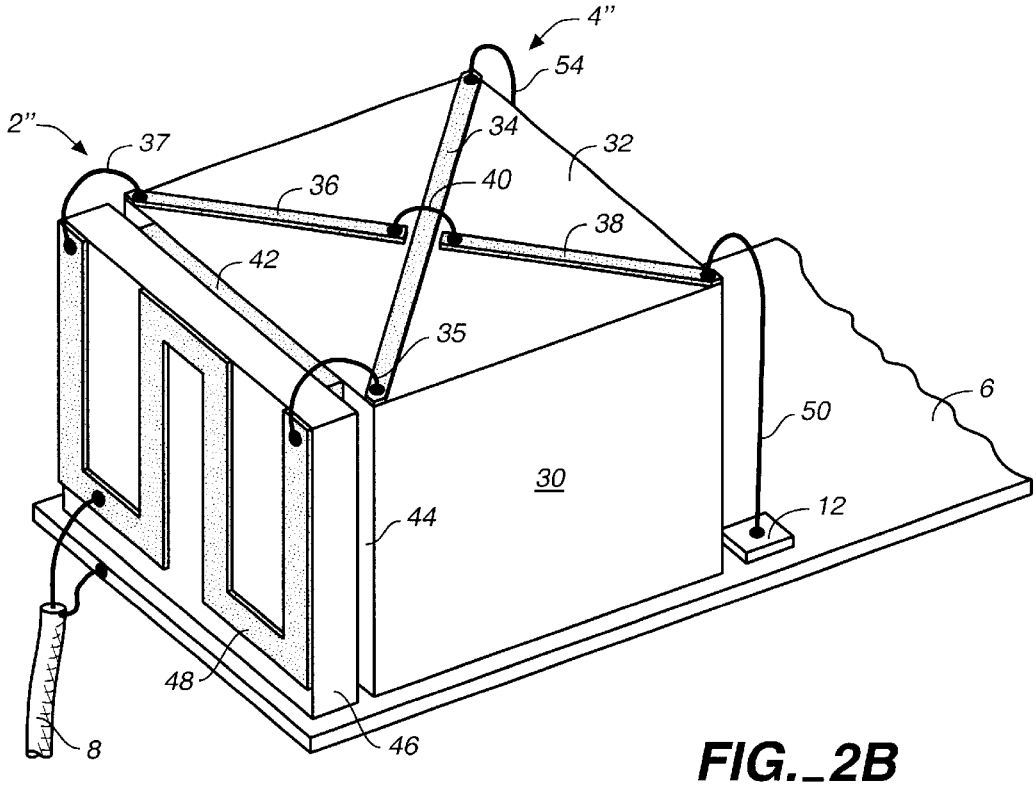
FIG. 2B is an idealized perspective view of another alternative embodiment of an antenna according to a first aspect of the invention.

A variation of the FIG. 2A embodiment is shown in FIG. 2B in which the microstrip phasing line is located, for convenience in fabrication, for example, at an angle with respect to the ground plane. The angle is not critical, but may be ninety degrees, particularly in the case where the space between the antenna driven elements and the ground plane is filled with a solid dielectric material. In such an embodiment, the portions of the antenna elements parallel to the ground plane may be printed on the top surface of the dielectric.

Referring to the details of the embodiment of FIG. 2B, a perspective view of an alternative embodiment of an idealized antenna according to the first aspect of the invention is shown. A solid dielectric block 30 is located on a ground plane 6. Block 30 may be generally cube-shaped. The central portions of the driven antenna elements 2" and 4" are printed on the top surface 32 of dielectric block 30 in the manner of traces on a printed circuit board. The portion of element 4" on the top of dielectric 30 may have a single trace 34, while the portion of element 2" on the top of the dielectric may have two traces 36 and 38 joined by a conductive wire 40 so as to avoid contact with trace 34. A conductive sheet 42 is located on a portion of the side 44 of the dielectric block 30. Sheet 42 has a height substantially the same as that of the dielectric block 30 but a narrower width for reasons to be explained. A dielectric sheet 46, thinner than the dielectric block 30 (its should be thin to maximize coupling to portions of trace 48, described below), is located on the side of conductive sheet 42 opposite dielectric block 30. Dielectric sheet 46 is substantially coextensive in height and width with side 44 of dielectric block 30. On the face of dielectric sheet 46, a serpentine or meandering printed circuit trace 48 is provided. One possible meandering pattern is shown in FIG. 2B. The vertical ends of meandering trace 48 are electrically connected to portions 36 and 34, respectively, of elements 2" and 4" by wires 37 and 35. The vertical ends of the meandering trace 48 and the wires37 and 35 form a portion of the elements 2" and 4", respectively. According to this example, starting at its upper-left-most part, the meandering trace 48 extends:

- downward at or near the edge of the sheet 46, such that it is outside the projected area of the conductive sheet 42, to a region near, but spaced from, the bottom edge of sheet 46,
- rightwardly, near, but spaced from, the bottom edge of sheet 46, such that it crosses into the projected outer edge of the conductive sheet 42,
- upward to a region at or near the upper edge of sheet 46,
- rightwardly at or near the upper edge of sheet 46,
- downward to a region near, but spaced from, the bottom edge of sheet 46,
- rightwardly, near, but spaced from, the bottom edge of sheet 46, such that it crosses beyond the projected outer edge of the conductive sheet 42, and
- upward at or near the edge of the sheet 46, such that it is outside the projected area of the conductive sheet 42, to a region at or near, the top edge of dielectric sheet 46.

The particular shape of the meandering pattern is not critical. However, it is desired that the outer vertical portions of the trace 48 are outside the projected area of the conductive sheet 42 because these outer portions are connected to the central portions of the elements 2" and 4" so as to constitute the vertical portions of the elements at the fed end of the elements. It is also desired that most of the remaining portion of the trace 48 is inside the projected area of the conductive sheet 42 so that this central part of the trace forms a microstrip transmission line having a ninety-degree electrical wavelength at the desired operating frequency of the antenna. The antenna may be fed by a coaxial cable that has its center conductor connected to a point at or near where the conductive trace 48 begins to be over the conductive sheet 42 and exhibit microstrip transmission line qualities. Its outer shield is connected to a nearby point on the conductive ground plane 6. Alternatively, the coaxial feedline may pass through in the manner of the alternate coaxial feed of the embodiment of FIG. 2A.

The ends of elements 2" and 4" may be connected by wires through capacitors to the ground plane 6 in the manner of the FIG. 1 and FIG. 2 embodiments (the wires thus constituting the other vertical portions of the two elements). For example, wire 50 connects trace 38 of element 2" to ground plane 6 through capacitor 52. A wire 54 connects trace 34 of element 4" to ground plane 6 through a further capacitor (not shown). Alternatively, instead of wires, conductive traces may be provided on the side of the dielectric block 30 with a short length of wire connecting the trace to one plate of each capacitor. As a further alternative, one or both of the capacitors could be also printed on the dielectric block as conductive traces. In order to obtain sufficient capacitance, the conductive trace pattern should be "interdigital" (i.e., in the manner of interleaved fingers or "digits").

Figure 2C:
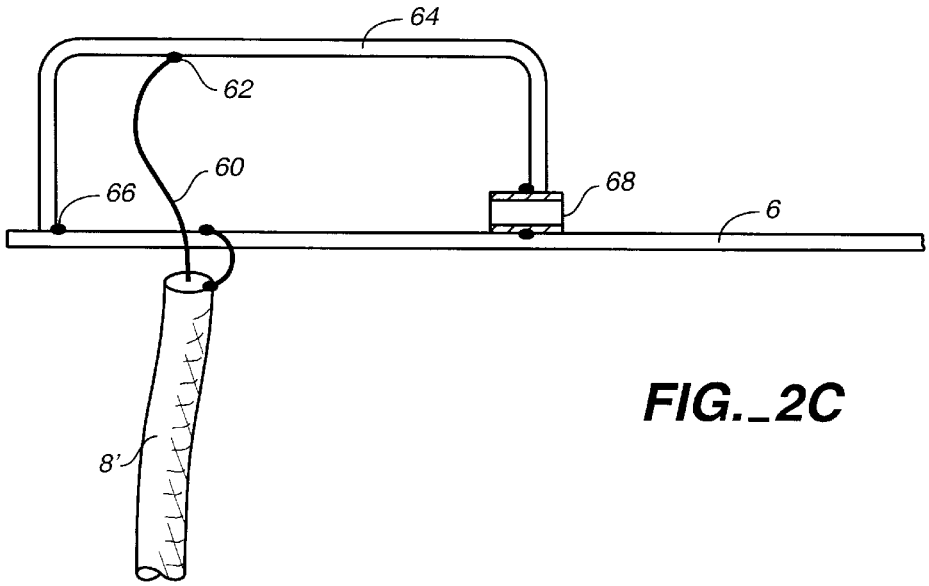
FIG. 2C is a side elevation view showing a shunt-feed alternative for feeding a driven element.

FIG. 2C shows how the driven elements of an antenna according to the first aspect of the invention may be shunt fed instead of directly fed. In this alternative, the center conductor of a nominally 100 ohmn coaxial feedline 8' is connected via a conductive wire 60 to a nominally 100 ohm tap point 62 on a driven element 64 (the two elements in parallel thus appear as a 50 ohm feed point provided that a 100 ohm phasing line is employed), while the shield of the coaxial feedline is connected to a nearby point on the ground plane 6. In case of shunt feed, the non-capacitor end 66 of the driven element is electrically connected to the ground plane 6. The distal end of the element 64 is coupled to the ground plane 6 through a capacitor 68 in the same manner as described above in connection with directly fed elements. While, in practice, either direct feed for both elements or shunt feed for both elements should be employed for simplicity in manufacture, in principle, one could directly feed one element and shunt feed the other.

Figure 3A:
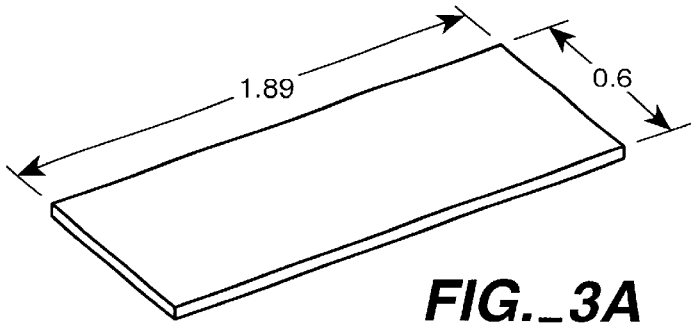
FIG. 3A is a perspective view of an embodiment of a conductive ground plane usable in a practical antenna according to a first aspect of the invention. Dimensions in inches suitable for operation in the 1.575 GHz (GPS) band are shown.

Referring to FIG. 3A, for a practical antenna configured in the manner of the FIG. 1 or FIG. 2A embodiments, but with driven elements having a cylindrical cross-section, a preferred set of dimensions in inches are shown for the ground plane 6 of FIGS. 1 and 2A for operation at or near 1.575 GHz. The thickness of ground plane 6 is not critical, but preferably is thin to minimize weight. As noted above, the cross-sectional shape of the elements is not critical and may be cylindrical, rectangular, or other.

Figure 3B:
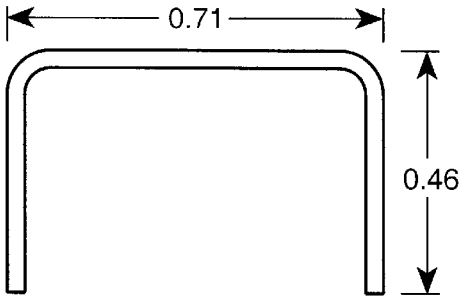
FIG. 3B is an end elevation view of an embodiment of a driven element usable in a practical antenna according to a first aspect of the invention. Dimensions in inches suitable for operation in the 1.575 GHz band are shown.
Figure 3C:
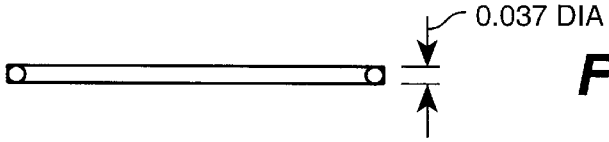
FIG. 3C is a plan view of the driven element of FIG. 3B.

Referring to FIGS. 3B and 3C, for a practical antenna configured in the manner of the FIG. 1 or FIG. 2A embodiments, but with driven elements having a cylindrical cross-section, a preferred set of dimensions in inches of the driven elements 2 and 4 of FIGS. 1 and 2A for operation at or near 1.575 GHz are shown. As noted above, the cross-sectional shape of the elements is not critical and may be cylindrical, rectangular, or other.

In an antenna having a configuration as shown in FIG. 1 and the dimensions of FIGS. 3A–3C, but with driven elements having a cylindrical cross-section, an approximate ratio of power radiated by the central portions of the elements as compared to the vertical portions of the elements is 2.25 to 1.

Figure 4A:
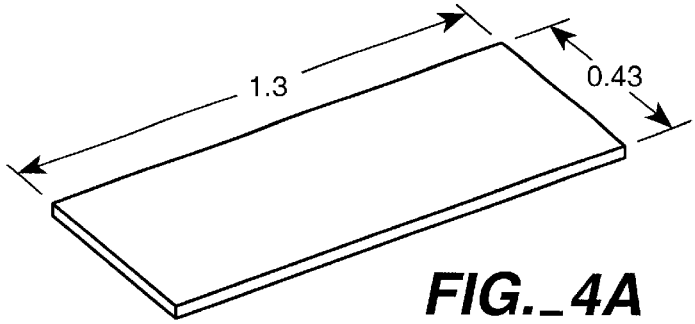
FIG. 4A is a perspective view of an embodiment of a conductive ground plane usable in a practical antenna according to a first aspect of the invention. Dimensions in inches suitable for operation in the 2.4–2.48 band are shown.

Referring to FIG. 4A, for a practical antenna configured in the manner of the FIG. 1 or FIG. 2A embodiments, but with driven elements having a cylindrical cross-section, one preferred set of dimensions in inches for the ground plane 6 of FIGS. 1 and 2A for operation over 2.4–2.48 GHz are shown. The thickness of ground plane 6 is not critical, but preferably is thin to minimize weight.

Figure 4B:
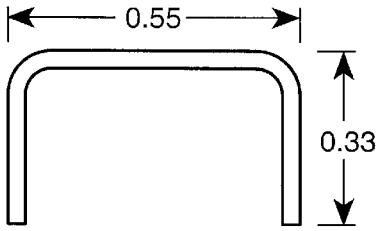
FIG. 4B is an end elevation view of an embodiment of a driven element usable in a practical antenna according to a first aspect of the invention. Dimensions in inches suitable for operation in the 2.4–2.48 GHz band are shown.
Figure 4C:
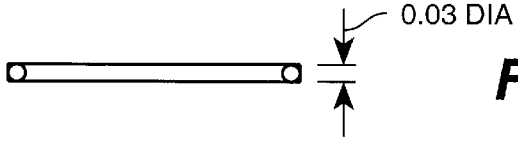
FIG. 4C is a plan view of the driven element of FIG. 3B.

Referring to FIGS. 4B and 4C, for a practical antenna configured in the manner of the FIG. 1 or FIG. 2A embodiments, one preferred set of dimensions in inches of the driven element sections from FIGS. 1 and 2A for operation over 2.4–2.48 GHz are shown.

The dimensions shown in FIGS. 3A–3C and 4A–4C are those of practical antennas constructed in accordance with aspects of the invention. Measured performance characteristics of the antenna of FIGS. 3A-3C configured in the manner of FIG. 1 are set forth in FIG. 5 and configured in the manner of FIG. 2A are set forth in FIGS. 6A–6H. It should be understood that the dimensions set forth in FIGS. 3A–3C and 4A–4C are not critical to the various aspects of the invention. In practice, the various conductor dimensions (including, for example, lengths and widths), conductor cross section shapes, conductor types, dielectric constants, and spacings may be varied. As is common practice, ordinary engineering skill will be required to trade off performance characteristics against other factors, particularly size and weight.

In the various embodiments, the driven elements cross each other at an angle of substantially 90 degrees. Variations of about plus or minus ten degrees from 90 degrees will still result in acceptable circular or elliptical polarization patterns. Also, in the various embodiments, the end portions of the driven elements need not be exactly perpendicular to the ground plane but may be at an angle of up to about 45 degrees with respect to the ground plane. Furthermore, the central portions of the driven elements need not be exactly parallel to the ground plane but may be at an angle of up to about 30 degrees with respect to the ground plane without seriously degrading the radiation pattern. In the case of L-shaped driven elements, a larger angle may be tolerated with degraded performance. Such variations may require resizing the elements and/or changing the capacitance of the resonating capacitors.

Figure 5:
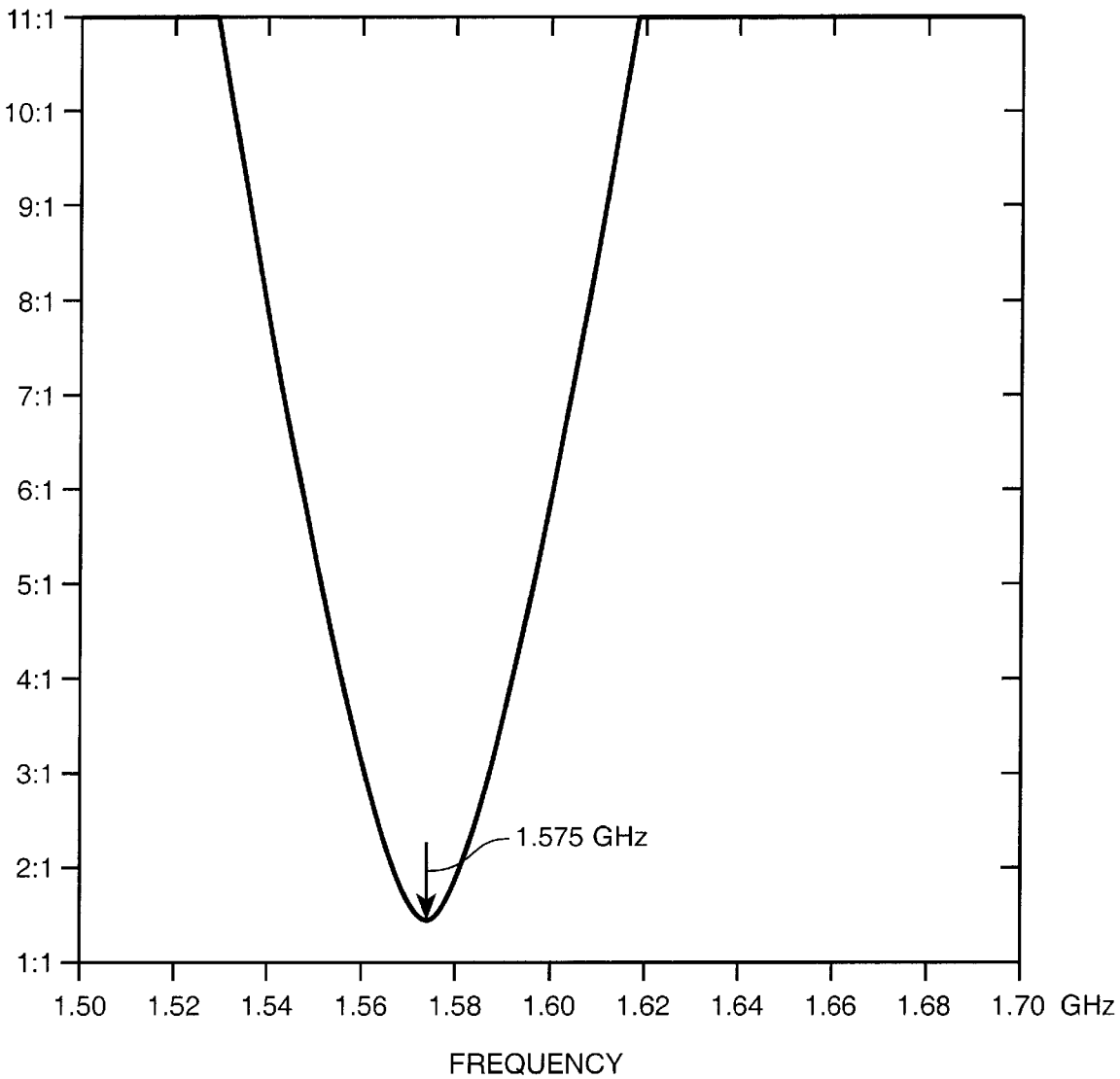
FIG. 5 shows the voltage standing wave ratio (VSWR) plot vs. frequency for a practical embodiment of an antenna configured in the manner of FIG. 1 and having the dimensions of the ground plane and driven elements of FIGS. 3A–3C.

Referring to FIG. 5, A VSWR vs. frequency plot for a practical embodiment of the antenna of FIG. 1 and having the dimensions set forth in FIGS. 3A–3C is shown. This plot shows a VSWR of 1.6:1 nominal at 1.575 GHz, indicating that the antenna is tuned for operation in the GPS band.

Figure 6A:
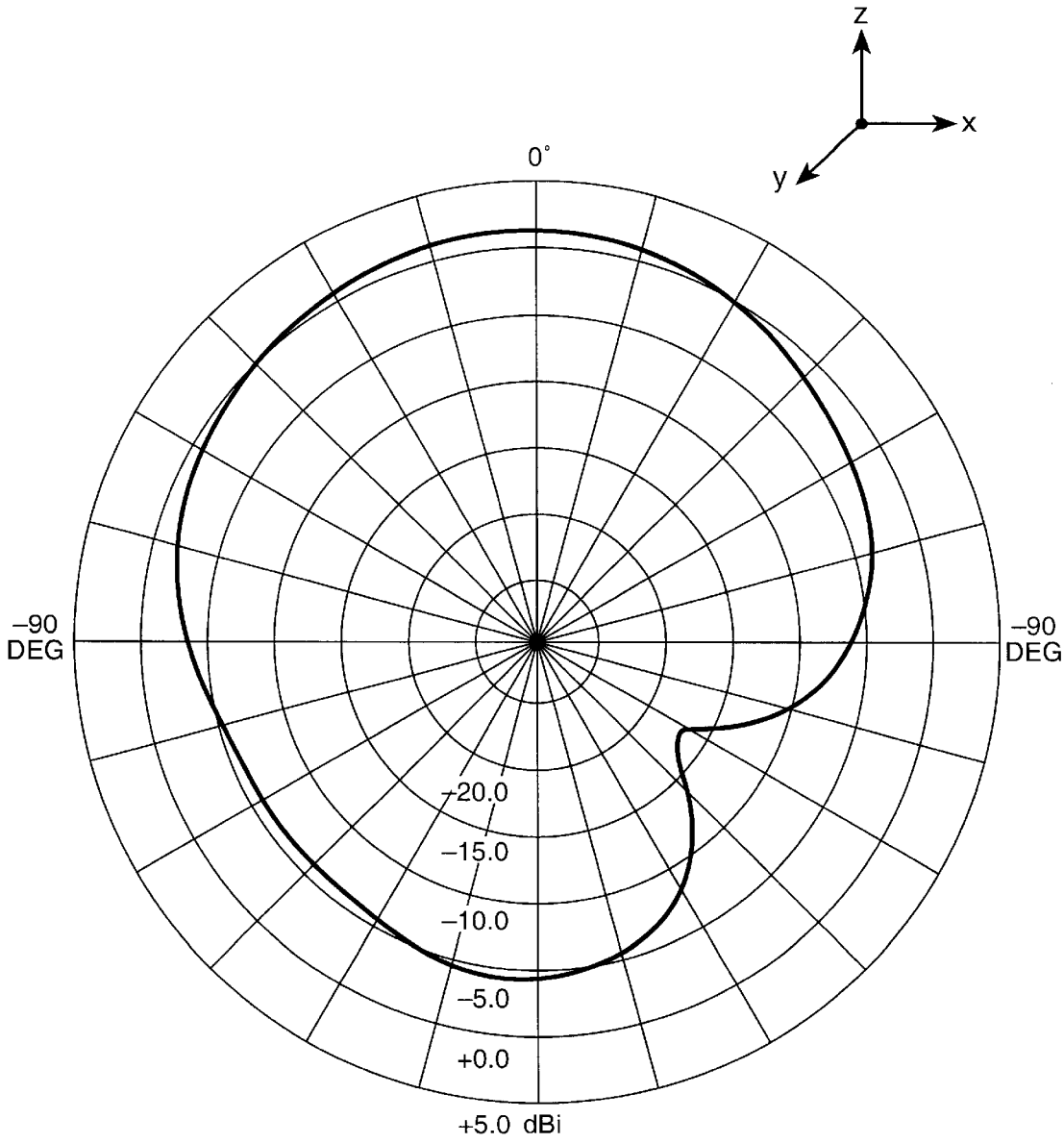
FIG. 6A–H are polar plots, plotting dBi versus angle, showing azimuth antenna patterns for a practical embodiment of an antenna configured in the manner of FIG. 2A and having the dimensions of the ground plane and driven elements of FIGS. 3A–3C, for various orientations of the antenna in free space.
Figure 6B:
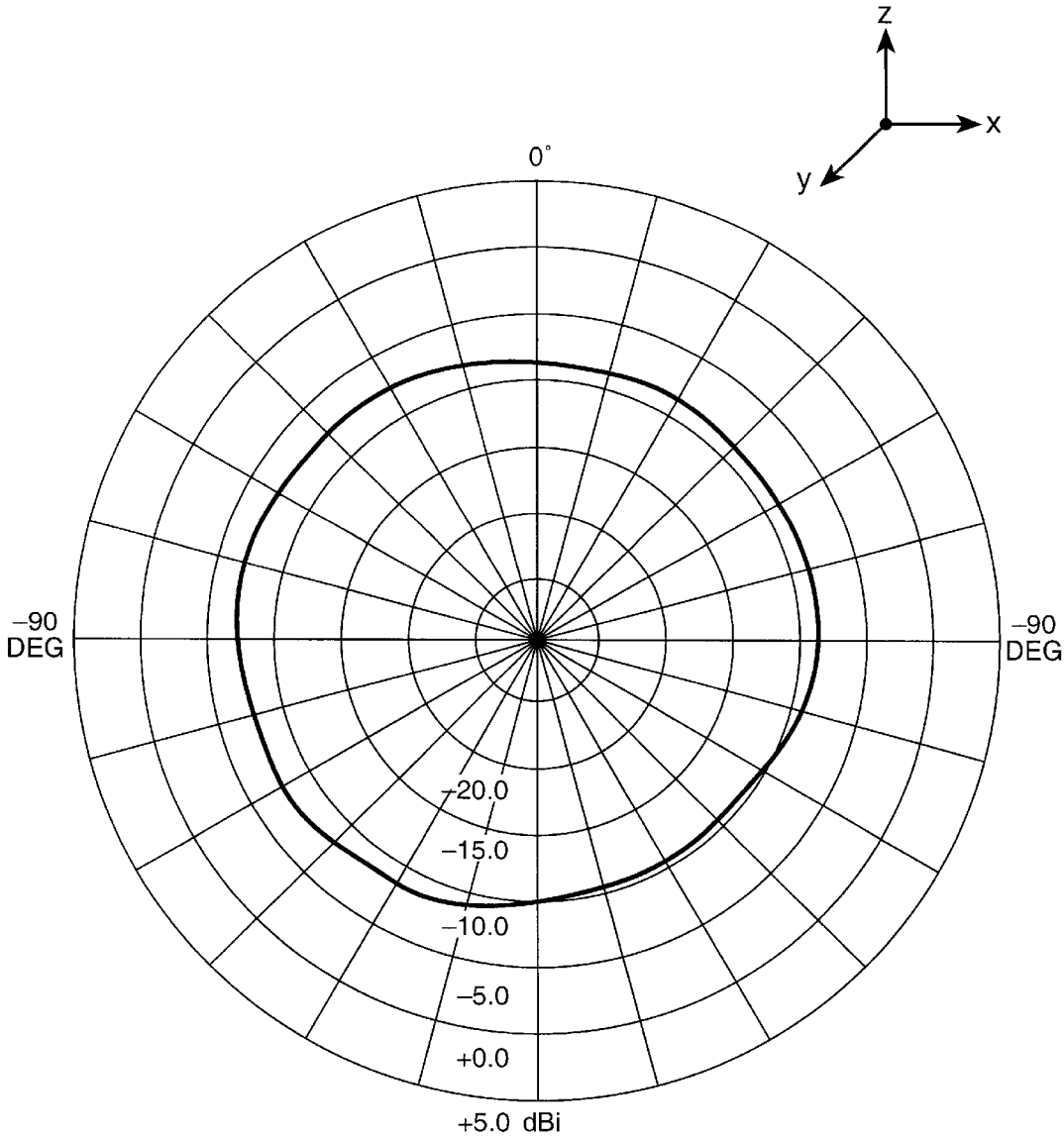
Figure 6C:
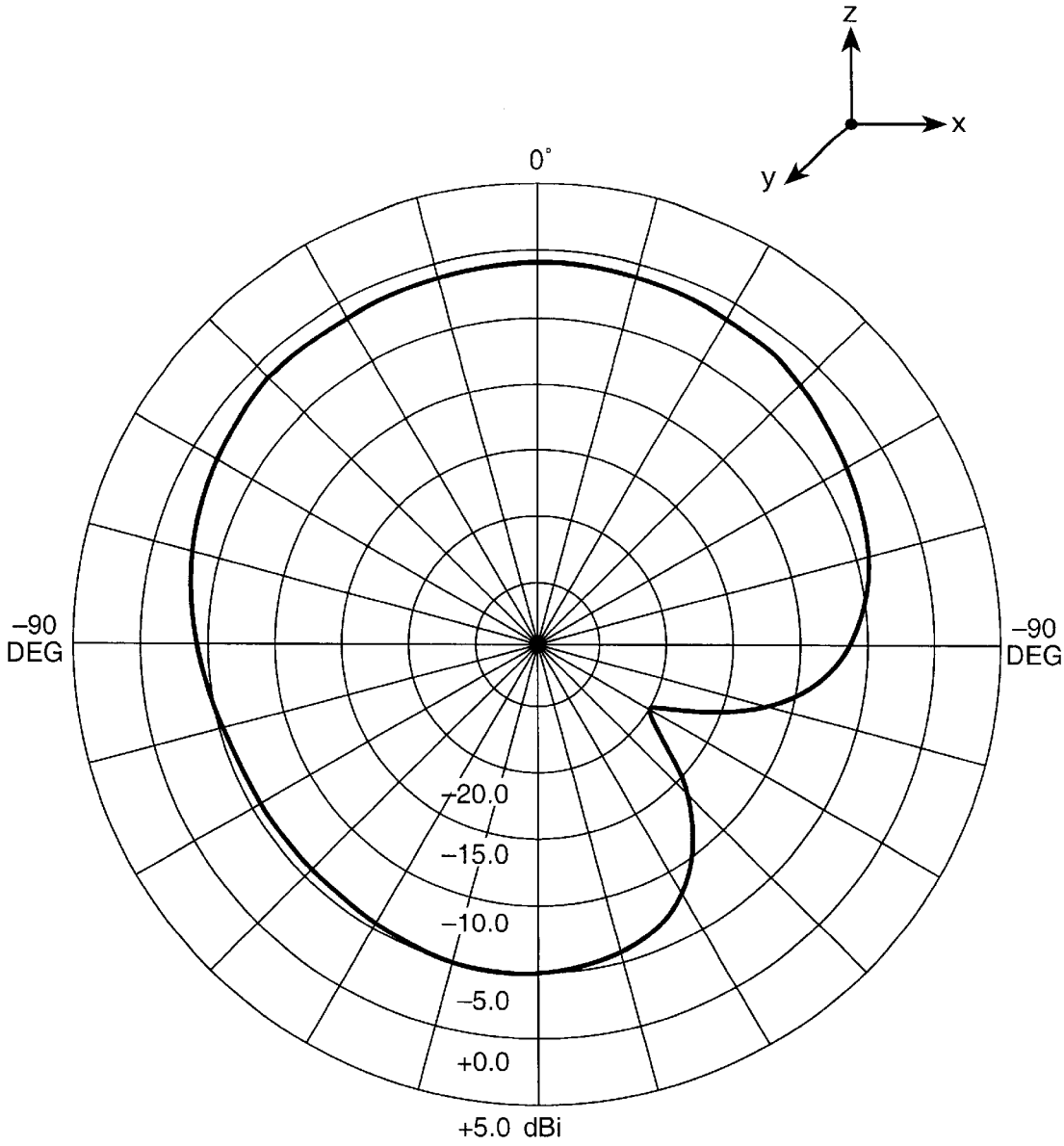
Figure 6D:
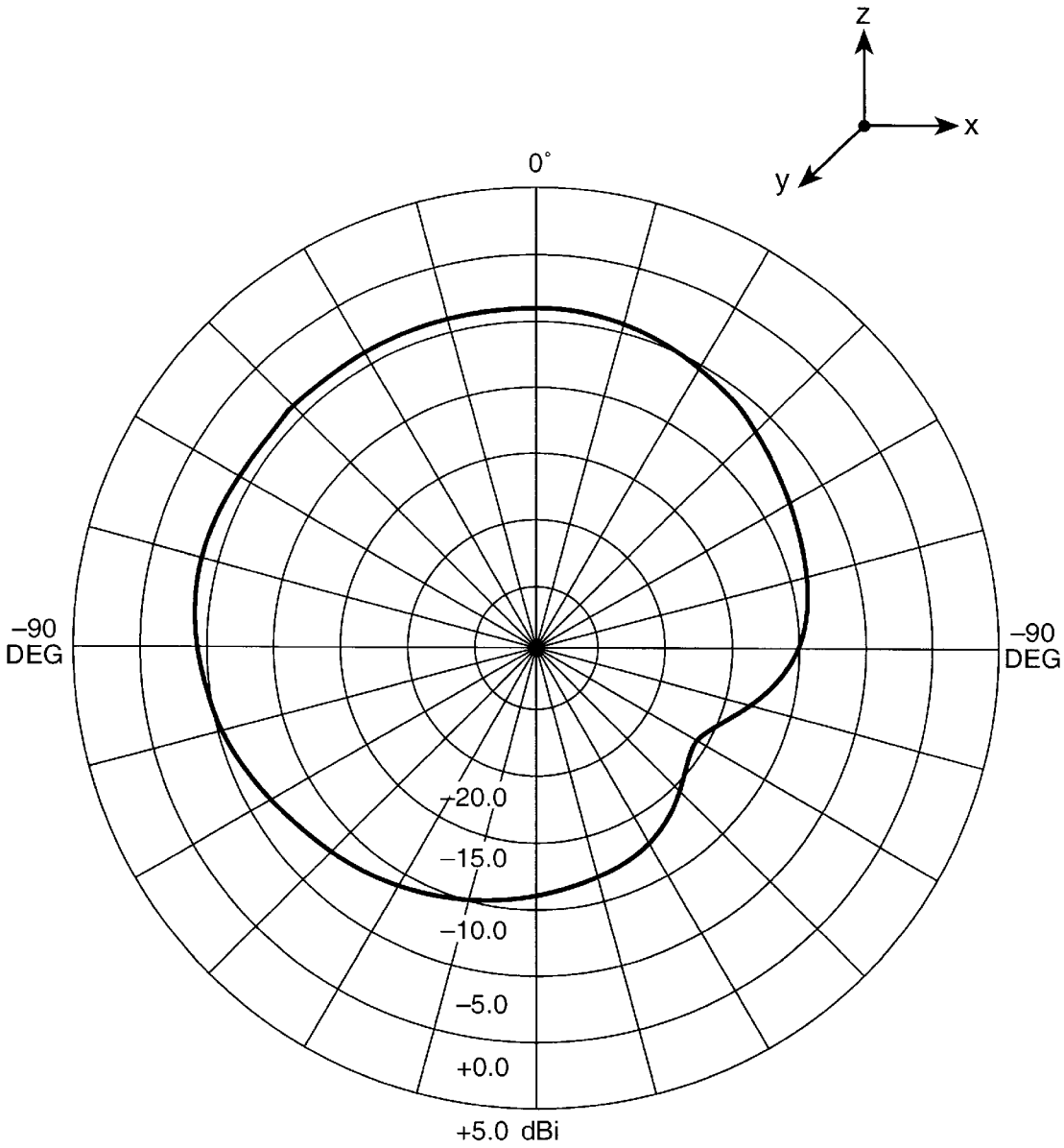

Referring to FIGS. 6A–6H, azimuth antenna patterns for a practical antenna configured as in FIG. 2A and having the dimensions of FIGS. 3A–3C are shown for various orientations of the antenna in free space and for vertical and horizontal range antenna polarization. The responses shown are the average response over the frequencies 1.56 GHz to 1.585 GHz. Other than FIG. 6D, the responses over the band of frequencies vary less than about 1 dB. In FIG. 6D, the responses vary by about 2 to 3 dB in the range of +90 degrees to −120 degrees. The patterns obtained are believed to be representative of those produced by crossed driven element over ground plane antennas according to any of the various embodiments disclosed herein.

In FIG. 6A, the ground plane initially is in the Y-Z plane with the longest dimension of the ground plane parallel to the Y-axis. Zero degrees on the plot is along the X-axis. The antenna was rotated around the Z-axis. The range measurement antenna is horizontal. The plot shows a generally cardiod pattern with the maximum horizontal radiation generally in the hemisphere above the plane of the ground plane with a peak of about +1.25 dBi. FIG. 6B is the same arrangement except that the range measurement antenna is vertical. The plot shows that the vertical radiation is generally uniform above and below the ground plane with a peak of about −7.5 dBi.

In FIG. 6C the ground plane initially is in the Y-Z plane with the longest dimension of the ground plane at a 45 degree angle to the Y and Z axes (thus, the ground plane is tilted at a 45 degree angle). Zero degrees on the plot is along the X-axis. The antenna was rotated around the Z-axis. The range measurement antenna is horizontal. The plot shows a generally cardiod pattern with the maximum horizontal radiation is generally in the hemisphere above the plane of the ground plane (with a peak of about −0.6 dBi) even when the ground plane is tilted. FIG. 6D is the same arrangement except that the range measurement antenna is vertical. The plot shows that the vertical radiation has a slightly cardiod pattern with reduced radiation generally below the ground plane (opposite the elements) with a peak of about −3.5 dBi.

Figure 6E:
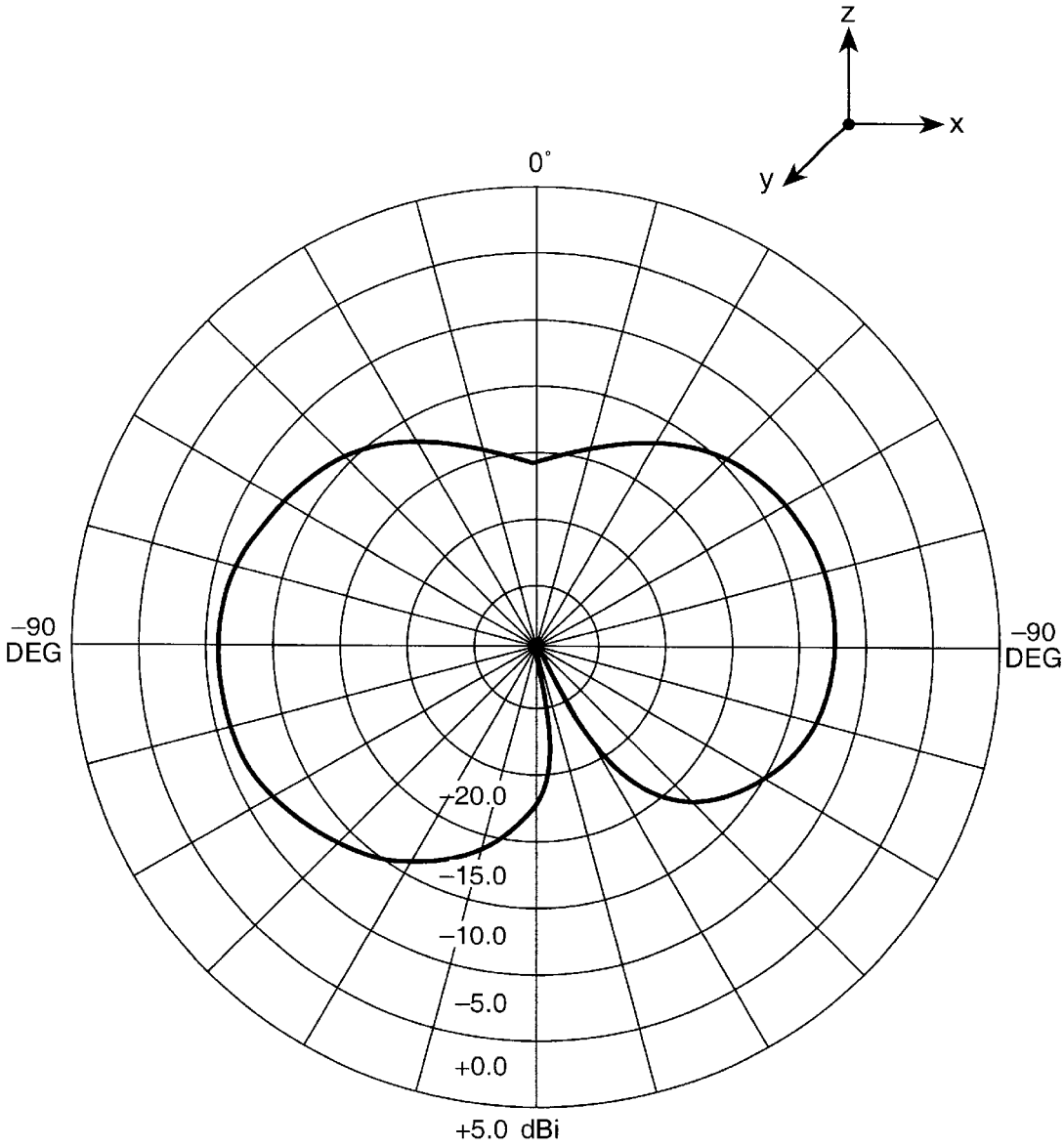
Figure 6F:
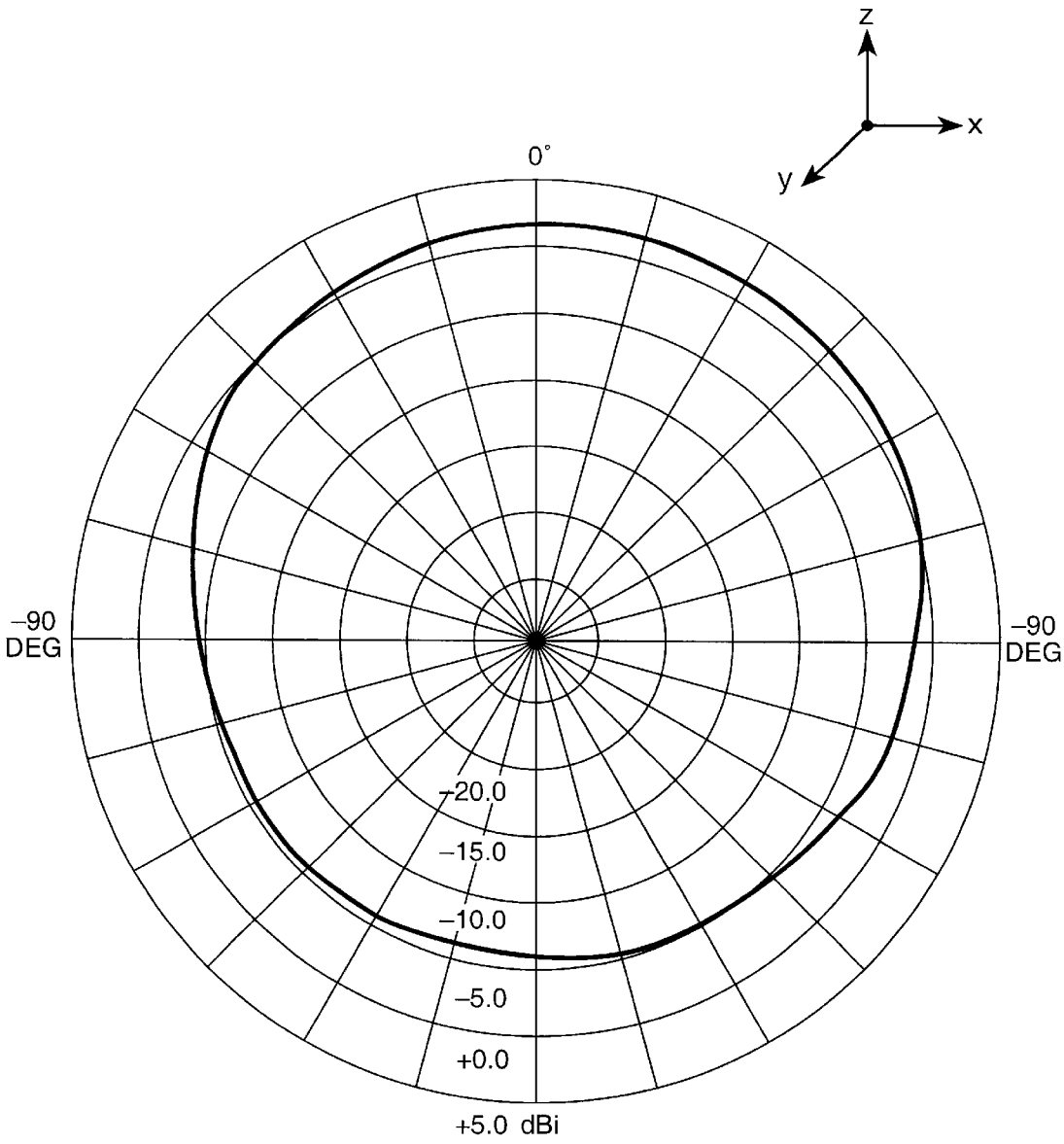

In FIG. 6E, the ground plane initially is in the Y-Z plane with the longest dimension of the ground plane parallel to the Z-axis. Zero degrees on the plot is along the X-axis. The antenna was rotated around the Z-axis. The range antenna was horizontal. The plot shows a generally figure-8 pattern with the maximum horizontal radiation generally off the sides of the ground plane. FIG. 6F is the same arrangement except that the range measurement antenna is vertical. The plot shows that the vertical radiation is generally uniform above and below the ground plane with a peak of about +1.8 dBi.

Figure 6G:
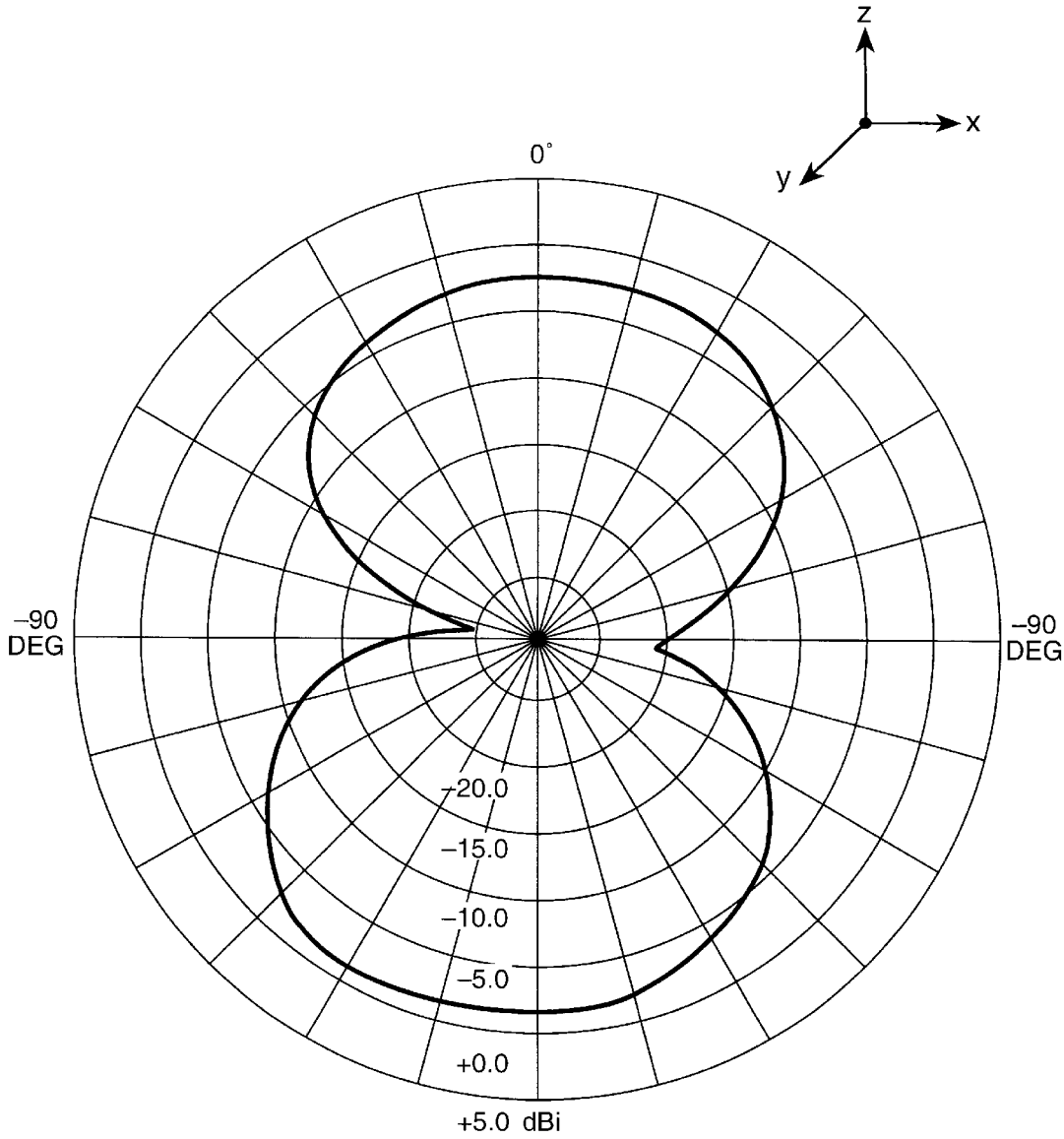
Figure 6H:
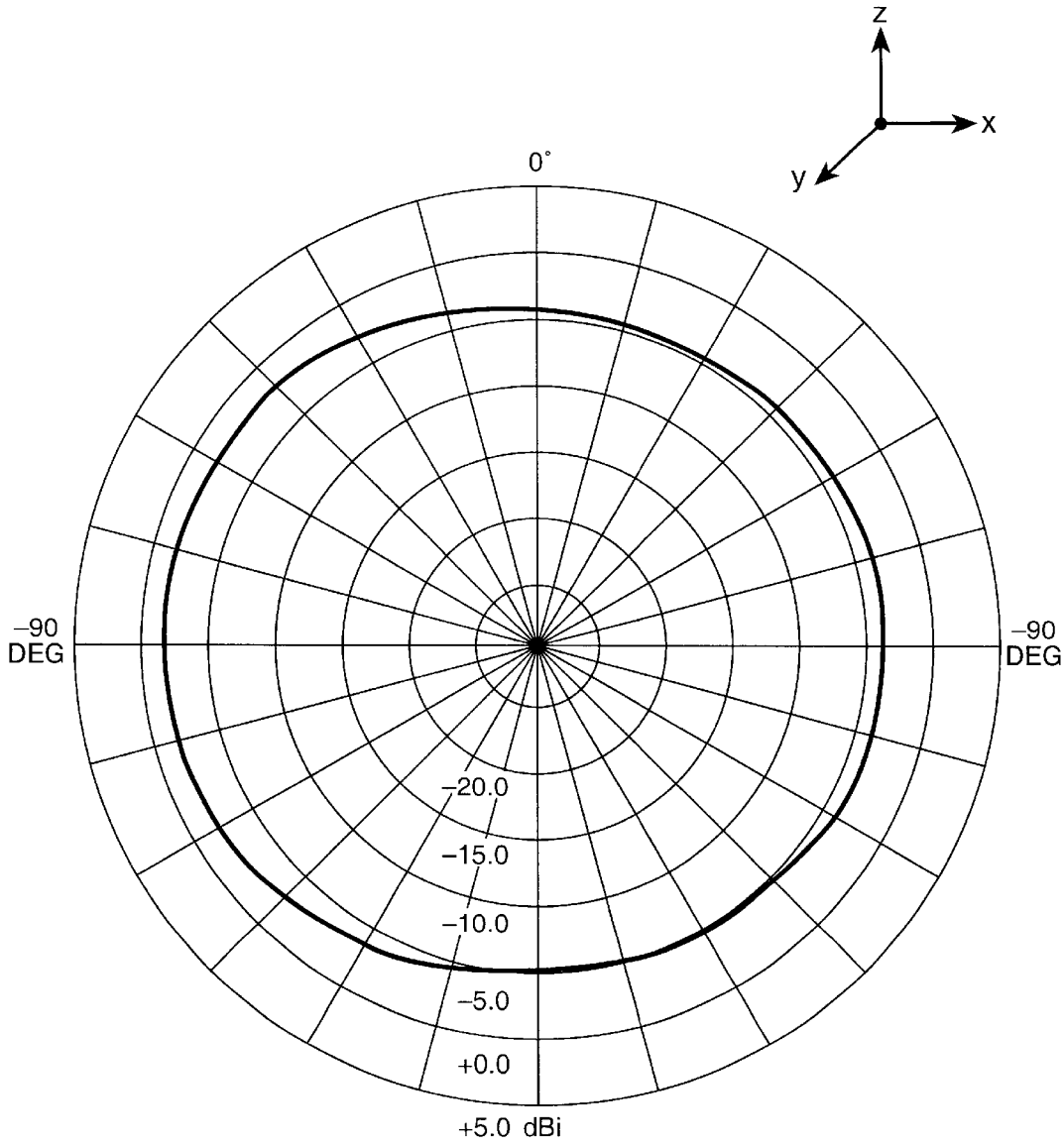

In FIG. 6G, the ground plane initially is in the X-Y plane with the longest dimension of the ground plane parallel to the Y-axis. Zero degrees on the plot is along the X-axis. The antenna was rotated around the Z-axis. The range measurement antenna was horizontal. The plot shows a generally figure-8 pattern with the maximum horizontal radiation generally off the long sides of the ground plane with a peak of about −1.4 dBi. FIG. 6H is the same arrangement except that the range measurement antenna is vertical. The plot shows that the vertical radiation is generally uniform around the ground plane with a peak of about −1.6 dBi.

Figure 7:
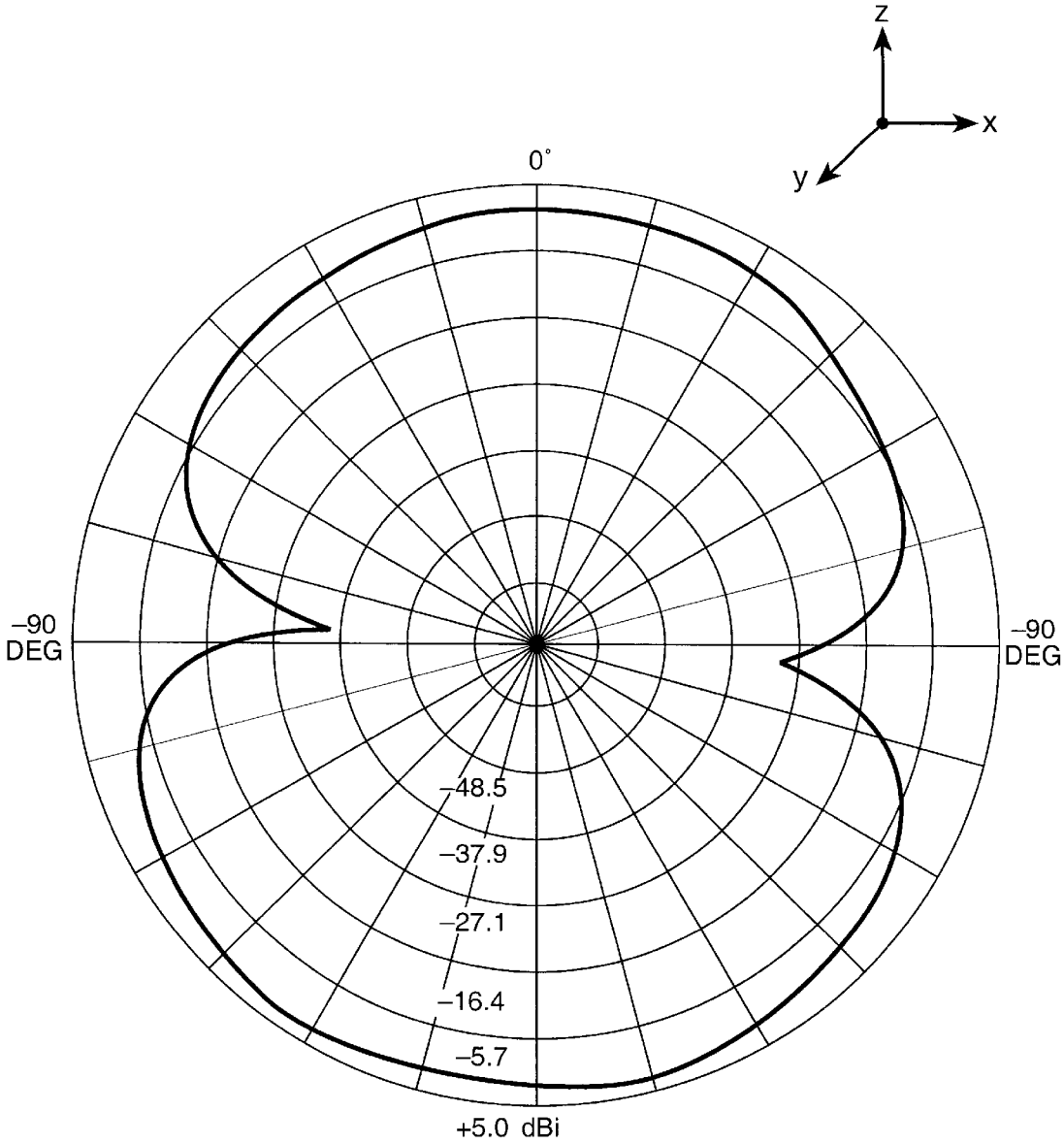
FIG. 7 shows, for comparison purposes, the azimuth antenna pattern for a horizontally polarized reference dipole.

Referring to FIG. 7, the azimuth pattern of a 1.575 GHz reference dipole is shown, and the peak gain value vs. frequency may be read from the table on the plot. The reference dipole is in the Y-Z plane and is rotated about the Z-axis. Initially, the long dimension of the dipole is parallel to the Y-axis with zero degrees perpendicular to the dipole axis. The range measurement antenna is horizontal. The dipole displays a classic figure-8 radiation pattern with a peak gain of about +2.1 dBi. The patterns of FIGS. 6A to 6H, compared to the reference dipole, show that reasonable gain and directivity is achieved at both range antenna polarizations, in the hemisphere above the antenna. Performance data similar to that of FIGS. 6A–6H may be obtained for other U-shaped element configurations of the antenna disclosed herein.

An antenna according to the present invention may also be configured so that the crossed driven elements and capacitors are associated with a molded dielectric, such a plastic or other suitable moldable dielectric. FIGS. 8–27C show aspects of such embodiments. Such capacitors are a second aspect of the present invention.

Figure 8:
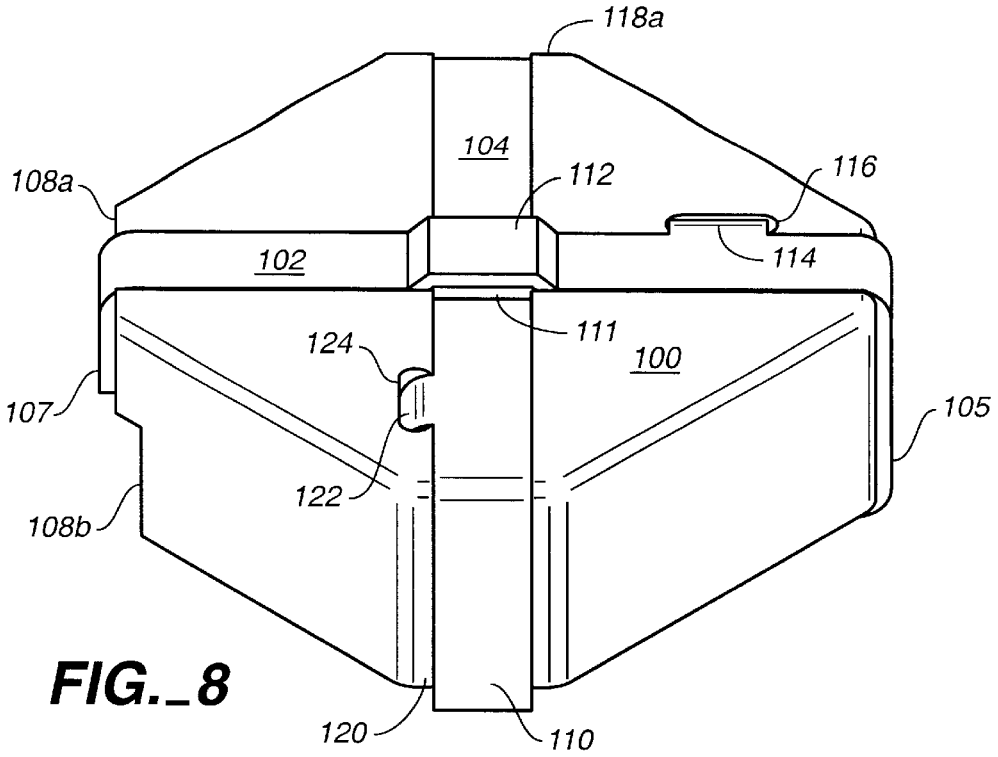
FIG. 8 is a perspective view of a portion of an antenna according to the first aspect of the present invention in which first and second crossed driven elements are wrapped around a molded dielectric base.
Figure 9:
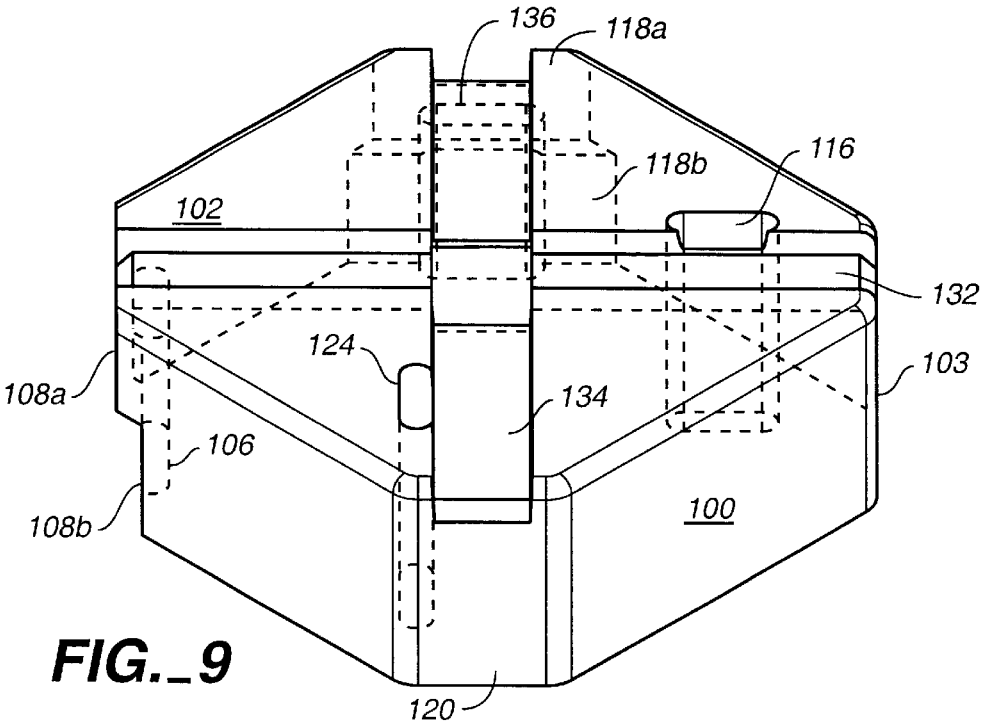
FIG. 9 is a perspective view of the molded dielectric base of FIG. 8, omitting the crossed driven antenna elements and showing features inside, under and on the unseen surfaces of the dielectric base in phantom.

FIG. 8 is a perspective view of a portion of an antenna according to the first aspect of the present invention in which first and second crossed driven elements 102 and 104 are wrapped around a molded dielectric base 100. A conductive ground plane is required but not shown in this view. The dielectric base may be molded before adding the conductive driven elements and other conductive elements to be described, or such conductive elements may be molded into the dielectric base when it is fabricated. Alternatively, the conductive elements may be plated onto the dielectric base when it is fabricated. FIGS. 8 and 9 show an embodiment in which the base is molded prior to adding conductive elements. Alternative embodiments relating to molded-in and plated fabrications are described below. These various embodiments provide precision capacitors for use in resonating the antenna elements. In further embodiments described below, no dielectric base is employed, but a molded dielectric is used to provide a mechanical connection and to hold conductive elements in such a way as to provide a precision capacitor.

Referring again to FIG. 8, elements 102 and 104 may be ribbon-like conductors having a width greater than their thickness. Their shape is not critical. They may be made from a formable metal with good conductivity properties, such as copper or aluminum. From a plan view, the base is generally square with flattened comers so that it has four primary and four narrower secondary sides. The base has channels in which the ribbon-like conductor elements lie (see FIG. 9). The general configuration of the base 100 is not critical, provided that it holds the various elements in their desired relationships.

As viewed in FIG. 8, the right-hand end of element 102 curves over a first flattened corner 103 of the base, a portion 105 extends downward over the side of the flattened corner, and, a further portion 146 (not visible in FIG. 8) then folds under the base in order to provide an electrical contact region underneath the base 100, as will be described below. A portion 107 of the left-hand end of element 102 curves down over the opposite flattened corner of the base. This second flattened corner of the base has an upper region 108*a* and a lower region 108*b*, wherein the lower region is stepped inward. The downward-going portion 107 of element 102 is shorter than the height of base 100 so as to cover at least a portion of the upper region 108*a*. As will be explained further below, this downward going portion 107 of element 102 acts as one plate of a parallel plate capacitor—thus, the other-capacitor-plate-facing portion of its length and width are factors in determining the value of the capacitor. A slot 106 (see FIG. 9) that opens only to the bottom of base 100, receives a separate conductive element 140 (not visible in FIG. 8), described further below, that forms the other plate of the parallel plate capacitor. Its other-capacitor-plate-facing portion (i.e., facing portion 107 of element 102) is also a factor in determining the value of the capacitor. The slot is configured so that the two capacitor-plate-forming conductors are substantially parallel at a precise desired spacing. The molded base thus can hold the two plates of the capacitor in a predetermined and controlled relationship to each other, thus providing a capacitor in which the capacitance is predictable and controllable with a high precision. The precision of the capacitor is also affected by the dielectric constant of the base 100. In this and other embodiments described below, the areas of the facing elements, their spacing and the qualities of the interposed dielectric will determine the capacitance value. Other embodiments, described below, while using a molded piece to precisely position the capacitor elements with respect to each other, have an air gap with very little non-air dielectric material between the capacitor elements in order to minimize the effect of variations in dielectric constant from antenna to antenna and reduce losses. An air gap with little or no non-air dielectric material between the capacitor plates is preferred.

Returning to the description of FIG. 8, the central portion of element 102 is generally flat with a raised segment 112 to avoid contact with element 104 that passes underneath it. Element 102 has a further portion 114 that extends from one side of the central portion between its raised center and its right end Portion 114 curves downward and passes through a slot 116 and out the bottom side of base 100 where it folds under the base to provide an electrical contact region underneath the base. The side-extending portion 114 is used for shunt feeding element 102.

Element 104, rotated substantially ninety-degrees from element 102 is substantially a mirror image of element 102 except that its central portion is depressed in region 111 to avoid contact with element 104 that passes over it. As with the embodiments described above, the distance between the two driven elements should be such that not only is there no electrical contact, but there is substantially no capacitive coupling. Thus, as viewed in FIG. 8, a portion 109 (not seen in FIG. 8) of the far end of element 104 curves down over a third flattened corner of base 100. This flattened side of the base also has an upper region 118*a* and lower region 118*b* (see FIG. 9), in the manner of regions 108*a* and 108*b* of the second flattened side, wherein the lower region is located inward of the other. The downward-going portion of this end of element 104 is shorter than the height of base 100 so as to cover at least a portion of the upper region 118*a*. As will be explained further below, this downward-going portion 109 of element 104 acts as one plate of a parallel plate. A slot 136 (see FIG. 9) that opens only to the bottom of base 100, receives a separate conductive element 142 (not seen in FIG. 8), described further below, that forms the other plate of the parallel plate capacitor. The slot is configured so that the two capacitor-plate-forming conductors are substantially parallel at a precise desired spacing. The molded base thus can hold the two plates of the capacitor in a predetermined and controlled relationship to each other, thus providing a capacitor in which the capacitance is predictable and controllable with a high precision. The precision of the capacitor is also affected by the dielectric constant of the base 100. Other embodiments, described below, while using a molded piece to precisely position the capacitor elements with respect to each other, have an air gap with very little non-air dielectric between the capacitor plate portions. A gap with little or no non-air dielectric between the capacitor plates is preferred.

A portion 110 of the closer end of element 104 (as viewed in FIG. 8) curves downward over the fourth flattened side 120, extends downward along the side of the flattened corner, and, a further portion 166 (not visible in FIG. 8) then folds under the base in order to provide yet a further electrical contact region underneath the base as will be described below. Element 104 also has a sideward extending portion 122 that curves downward and passes through slot 122 and out the bottom side of base 100 where it folds under the base to provide another electrical contact region 112 (not seen in FIG. 8) underneath the base 100. The side-extending portion is used for shunt feeding element 102.

FIG. 9 is the same view as FIG. 8 but omits antenna elements 102 and 104 and shows features inside, under and on the unseen surfaces of base 100 in phantom. The base 100 has channels 132 and 134 sized to hold elements 102 and 104, respectively. Slots 116 and 124 are shown extending through to the bottom of base 100. Slots 106 and 136 extending from the bottom side of the base to hold the second parallel capacitor elements are shown. In addition, the manner in which the lower portions of flattened sides 108 and 118 step inward is better seen.

Figure 10:
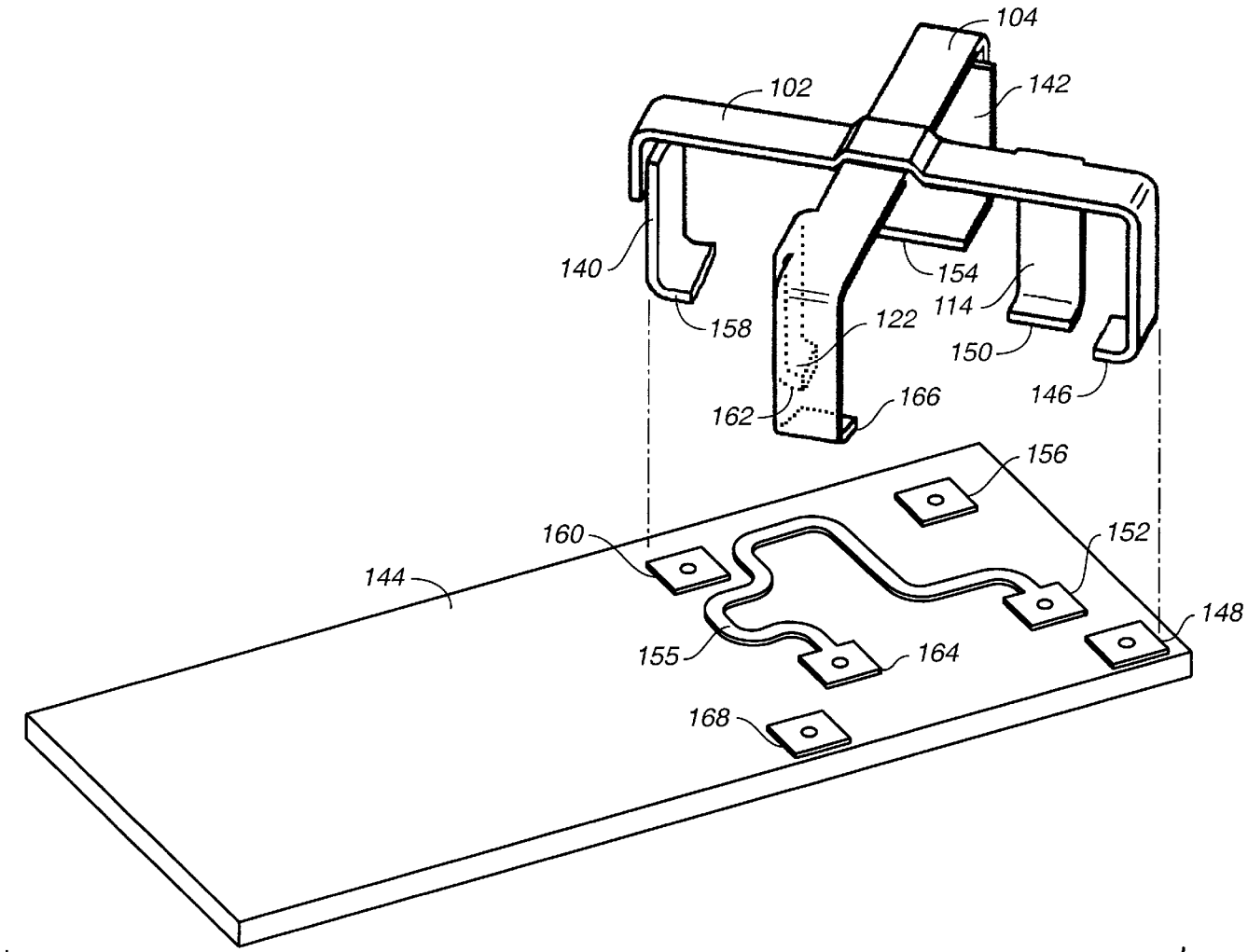
FIG. 10 is an exploded perspective view showing the two crossed driven elements, the two second capacitor plate elements, and the underlying ground plane that has a plurality of electrical contact pads and quarter-wave microstrip line.

FIG. 10 is an exploded perspective view showing the two crossed driven elements 102 and 104 of FIGS. 8 and 9 (along with their shunt feed side extensions 114 and 122, respectively), the two second capacitor plate elements 140 and 142, and an underlying ground plane 144 that has a plurality of electrical contact pads and quarter-wave microstrip line as will be described. For clarity, one or more elements for mechanically holding the depicted elements in place are omitted in this view. Ground plane 144 is substantially planar at least in the region of the crossed driven elements and may be either a continuous conductive piece or a discontinuous conductive piece such as a PWB, as mentioned above. As mentioned above, element 102 has a folded under electrical contact portion, indicated here at 146. When assembled:

- electrical contact portion 146 of the element 102 contacts electrical contact pad 148,
- electrical contact portion 150 of the shunt feed extension 114 contacts electrical contact pad 152,
- electrical contact portion 154 of the capacitor plate element 142 contacts electrical contact pad 156,
- electrical contact portion 158 of the capacitor plate element 140 contacts electrical contact pad 160, and
- electrical contact portion 162 (seen in phantom) of the shunt feed extension 122 contacts electrical contact pad 164, and
- electrical contact portion 166 of the element 104 contacts electrical contact pad 168.

Each of the electrical contact portions of the elements can be soldered to its respective contact pad by reflow soldering or other-wise. All of the electrical contact pads are electrically connected to the conductive ground plane 144 so that they are grounded except for the ground pads at the ends of a quarter-wave microstrip transmission line 155 (a quarter wavelength at or near the desired operating frequency of the antenna). The quarter-wave microstrip line 155 is insulated from the conductive ground plane 144 by a dielectric and has the above-mentioned electrical contact pads 152 and 164 at its ends. A feedline may be connected to the microstrip line in the manner shown in FIG. 2A or 2B, for example. The orientation of the crossed loops and respective conductive pads on the ground plane with respect to the ground plane are not critical. They may be reoriented, for example, by rotating them ninety-degrees with respect to the ground plane.

Figure 11:
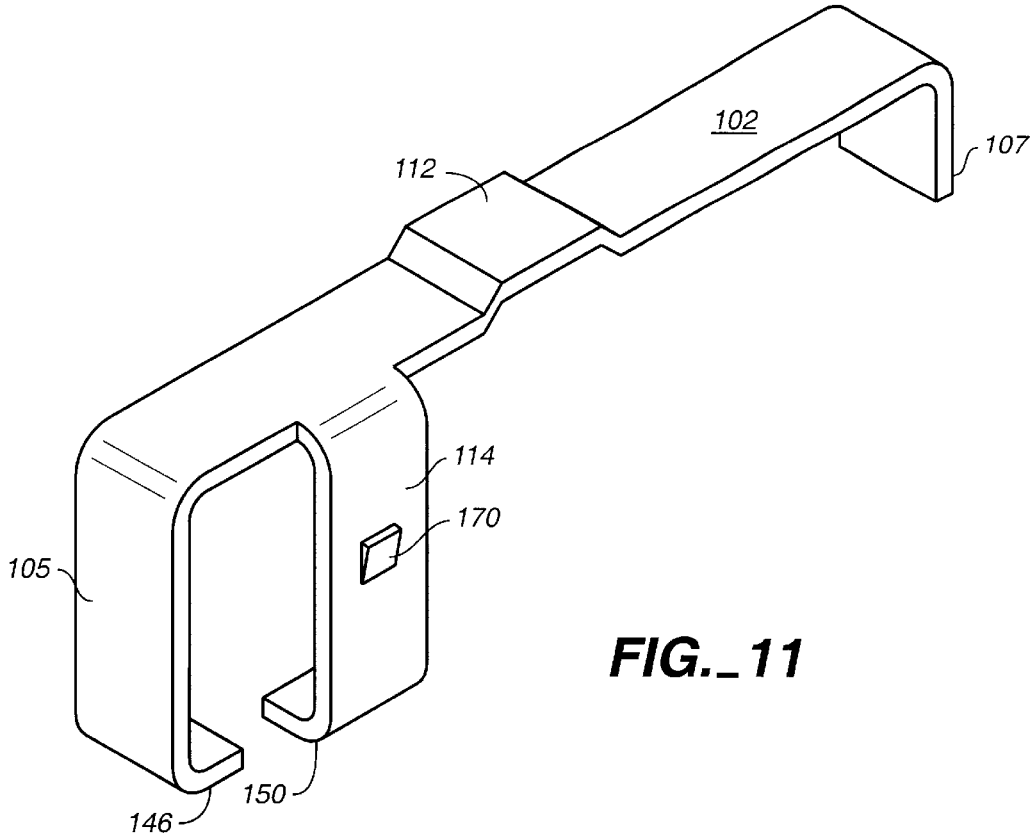
FIG. 11 is a perspective view of one of the driven elements.
Figure 12:
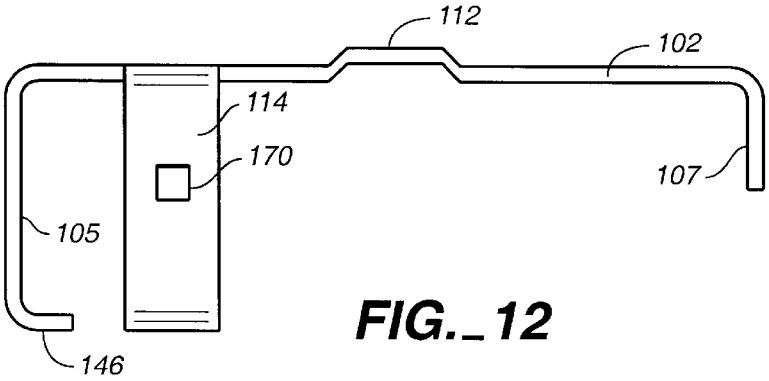
FIG. 12 is a side elevation view of the driven element of FIG. 11.
Figure 13:
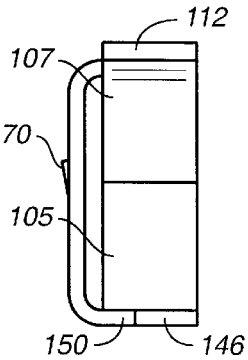
FIG. 13 is an end elevation view of the driven element of FIG. 11.
Figure 14:
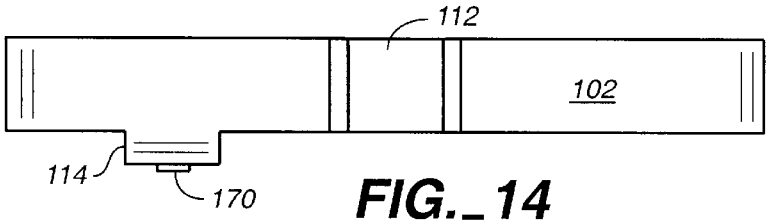
FIG. 14 is a top plan view of the driven element of FIG. 11.

FIG. 11 shows a perspective view of the driven element 102, showing more clearly its center raised portion 112, its end portion 107 that forms one plate of a capacitor, its opposite end portion 105 that wraps around the molded dielectric base 100 (not shown in FIG. 11), its electrical contact 146 for the grounding the end of the element, and its shunt feed extension 114 with the shunt feed electrical contact 150 and an optional fastening feature 170. FIG. 12 is a side elevation view of driven element 102. FIG. 13 is an end elevation view (viewed looking at the right side of the element in FIG. 12). FIG. 14 is a top elevation view of driven element 102.

Figure 15:
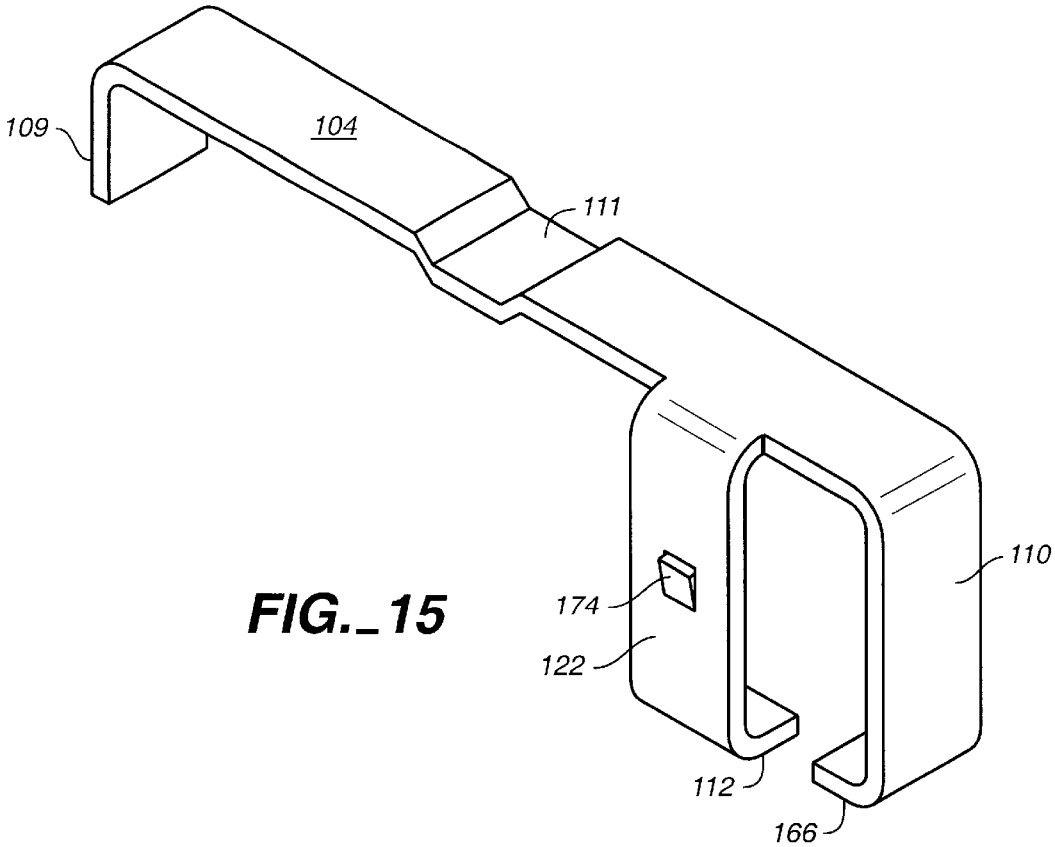
FIG. 15 is a perspective view of the other one of the driven elements.
Figure 16:
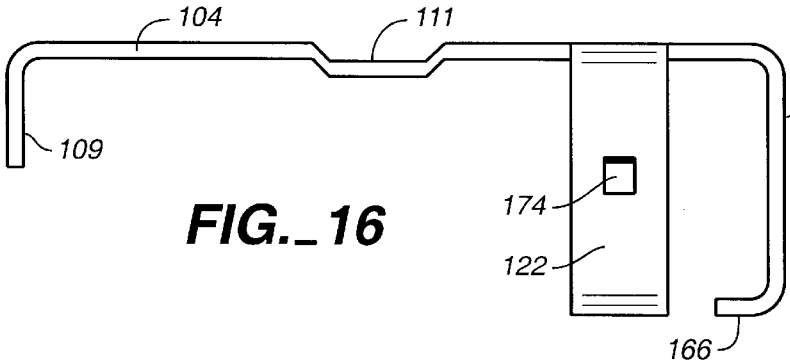
FIG. 16 is a side elevation view of the driven element of FIG. 15.
Figure 17:
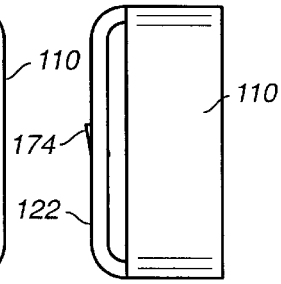
FIG. 17 is an end elevation view of the driven element of FIG. 15.
Figure 18:
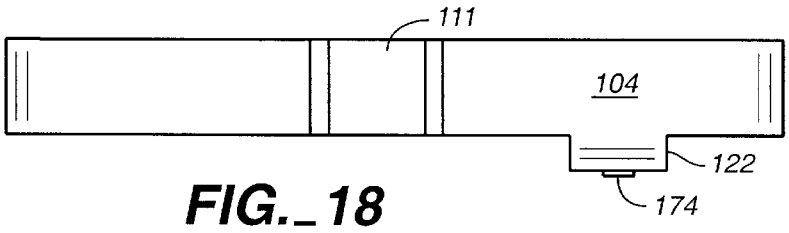
FIG. 18 is a top plan view of the driven element of FIG. 15.

FIG. 15 shows a perspective view of the driven element 104, showing more clearly its center depressed portion 111, its end portion 109 that forms one plate of a capacitor, its opposite end portion 110 that wraps around the molded dielectric base 100 (not shown in FIG. 15), its electrical contact 166 for the grounding the end of the element, and its shunt feed extension 122 with the shunt feed electrical contact 112 and an optional fastening feature 174. FIG. 16 is a side elevation view of driven element 102. FIG. 17 is an end elevation view (viewed looking at the right side of the element in FIG. 16). FIG. 18 is a top elevation view of driven element 102.

Figure 19:
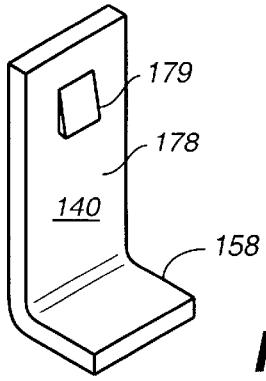
FIG. 19 is a perspective view of one of the conductive elements that forms the other plate of each respective parallel plate capacitor.
Figure 21:
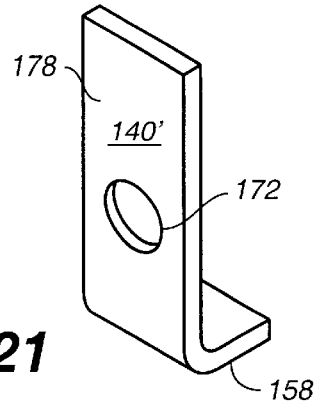
FIG. 21 is a perspective view of an alternative embodiment of one of the conductive elements that forms the other plate of each respective parallel plate capacitor.
Figure 20:
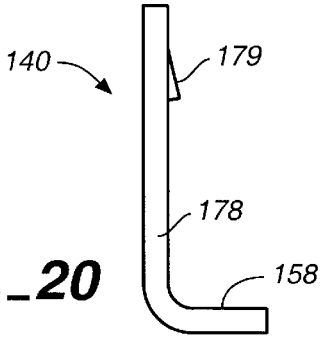
FIG. 20 is a side elevation view of the element of FIG. 19.
Figure 22:
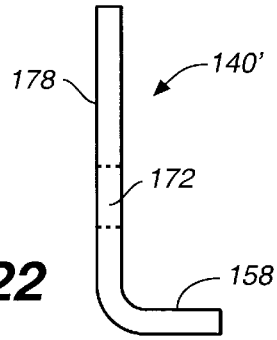
FIG. 22 is a side elevation view of the element of FIG. 21.

Details of the two separate conductive elements 140 and 142 that form the other plate of each respective parallel plate capacitor are shown in FIGS. 19–22. For simplicity in manufacture, the two elements 140 and 142 are substantially identical, as are the other-capacitor-plate portions 107 and 109 of the driven elements and the configuration of the capacitor-element-holding portions of the molded base. FIG. 19 is a perspective view of one such generally L-shaped element 140 of the type employed in the embodiment of FIGS. 8 and 9 (element 142 is identical). The element has a first portion 178 having an extending feature 179 in the manner of the driven elements so that they can be inserted into the receiving slots 106 and 136 and held securely in place. FIG. 20 shows an end elevation view of an element 140 having a feature 179. FIGS. 21 and 22 show an alternative version of the element, designated 140'. In this variation, a generally round hole 172 is used for holding the element in place in the molded base 100 (not shown) when the element is held in place by fitting the hole 172 over a matching protrusion in the side wall of the base 100 and then heating it to provide a heat stake for securely holding the element in the manner as described below in connection with FIG. 23D. FIG. 22 shows an end elevation view of element 140'. The various views also show the manner in which the element curves to provide a folded-under electrical contacting portion 158.

Figure 23A:
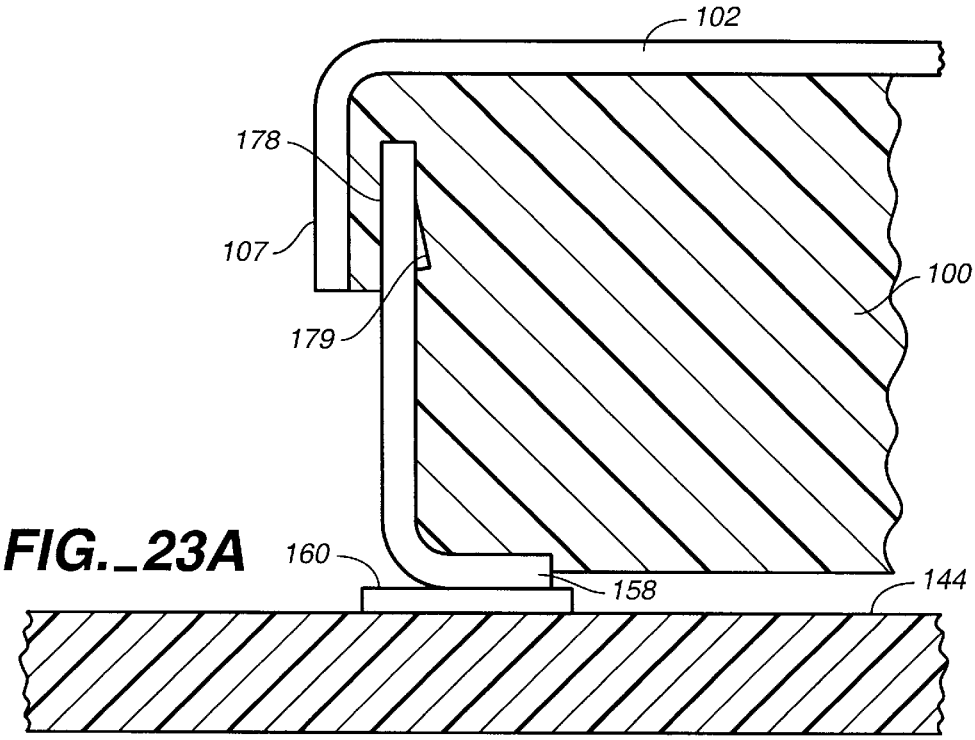
FIG. 23A is a partly cross-sectional side elevation view of one of the parallel plate capacitor regions of the arrangement of FIGS. 8 and 9

FIG. 23A is a partly cross-sectional side elevation view of one of the parallel plate capacitor regions of the arrangement of FIGS. 8 and 9. The electrical contact portion 158 of the parallel plate capacitor element 140 contacts pad 160 on the ground plane 144. Pad 160 is connected to the ground plane 144 so that it is grounded. The spacing between the capacitor plates (portions 107 and 178) and their orientation with respect to each other is precisely defined by the thickness of the molded dielectric material between them. In the FIG. 23A arrangement, the base is molded and subsequently the driven element and capacitor second plate elements are added. Before the lower portions of the elements are folded under, the shunt feed extension portions 114 and 122, respectively, of driven elements 102 and 104 are inserted into slots 116 and 124, respectively (elements 114, 122, 116 and 124 are not seen in FIG. 23A). Then the respective end portions 146, 150, 112 and 166 of the driven elements are folded over to fasten the driven elements to the base 100 (elements 146, 150, 112 and 166 are not seen in FIG. 23A). The second capacitor plate element 140 is inserted into its slot 106 (slot 106 is essentially filled with element 140 in FIG. 23A and, thus, is not seen in that figure) so that its extending feature 179 holds it into place. The second capacitor plate element 142 is inserted into its slot 136 and is held into place in the same manner (not seen in FIG. 23A).

Figure 23B:
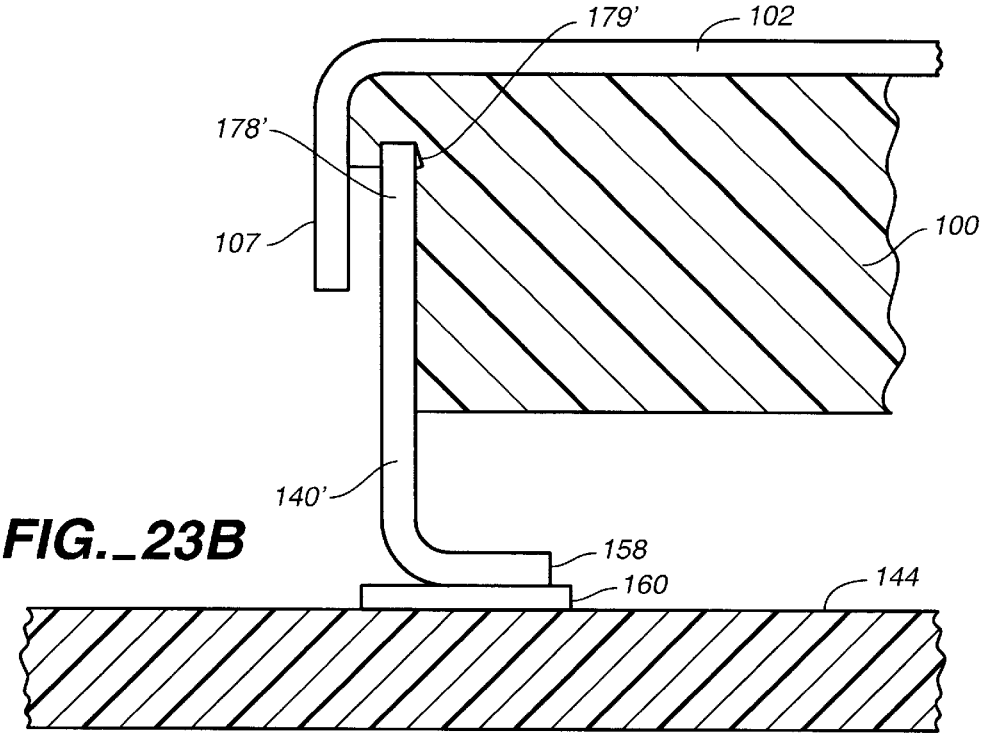
FIG. 23B is a partly cross-sectional side elevation view of one of the parallel plate capacitor regions having an alternative configuration.

In the FIG. 23A embodiment, the gap between the capacitor plate elements is molded dielectric material. As mentioned above, it is preferred to provide an air gap so that production variations in the dielectric constant of the molded material do not affect the precision of the capacitance and do not cause power losses. Thus, in FIG. 23B, which is also a partly cross-sectional side view, only a portion of the gap between the second capacitor plate element portion 178' and the facing portion 107 of the driven element 102 is molded dielectric material. Most of the gap is an air gap. Only the tip region of portion 178', the capacitor plate portion of element 140', is inserted in a slot in order that the feature 179' on portion 178' locks the element 140' in place (feature 180' is located nearer the end of portion 178' than is feature 180 on portion 178 in FIG. 23A). FIG. 23B also shows a further modification that may be employed in this and other embodiments—the base 100' is thinner such that the bottom of the base 100' is spaced farther from the folded under portion 158 of the element 140 and, consequently, from the underlying ground plane 144. This modification has the advantage of reducing dielectric losses in the base 100 and reducing the weight of the antenna. A thinner dielectric base may also be used in other embodiments.

Figure 23C:
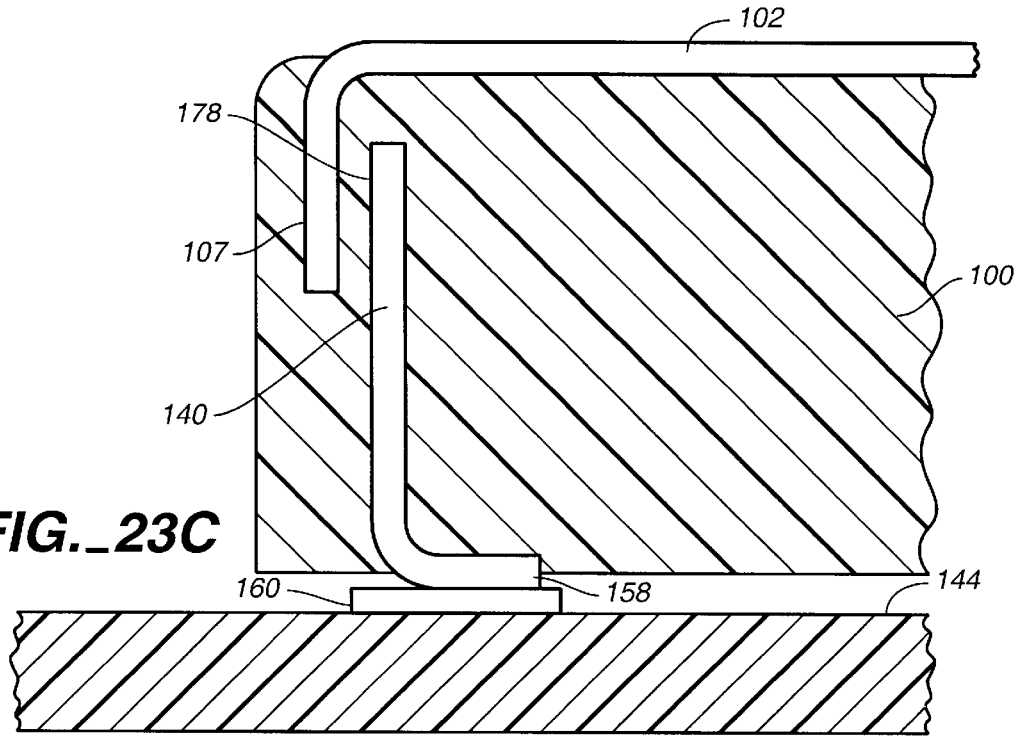
FIG. 23C is a partly cross-sectional side elevation view of one of the parallel plate capacitor regions having an alternative configuration.

FIG. 23C is a partly cross-sectional side elevation view of one of the parallel plate capacitor regions in an arrangement in which the driven element 102 and the second plate parallel-plate-capacitor element 140 are insert molded into the molded base 100' (as are elements 104 and 144 in the same manner).

Figure 23D:
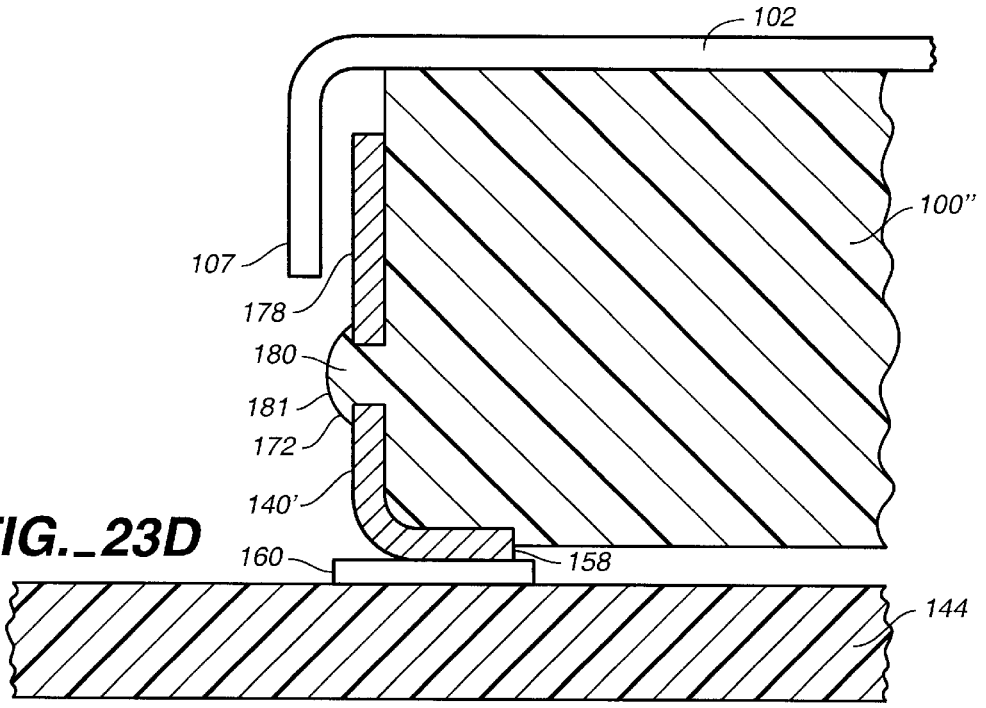
FIG. 23D is a partly cross-sectional side elevation view of one of the parallel plate capacitor regions having an alternative configuration.

FIG. 23D is a partly cross-sectional side elevation view of one of the parallel plate capacitor regions. In this case, rather than providing a dielectric between them, an air gap is provided between the capacitor plates 107 and 178. As in the FIG. 23A embodiment, in the FIG. 23C embodiment, the base is molded and subsequently the driven element and capacitor second plate elements are added. However, in the FIG. 23C arrangement, the second plate capacitor element is held into place by fitting the hole 172 over a matching rod-like protrusion 180 in the side wall of the base 100" instead of inserting the element into a slot. The end of the protrusion is heated to provide a heat stake for holding the element in place.

Figure 23E:
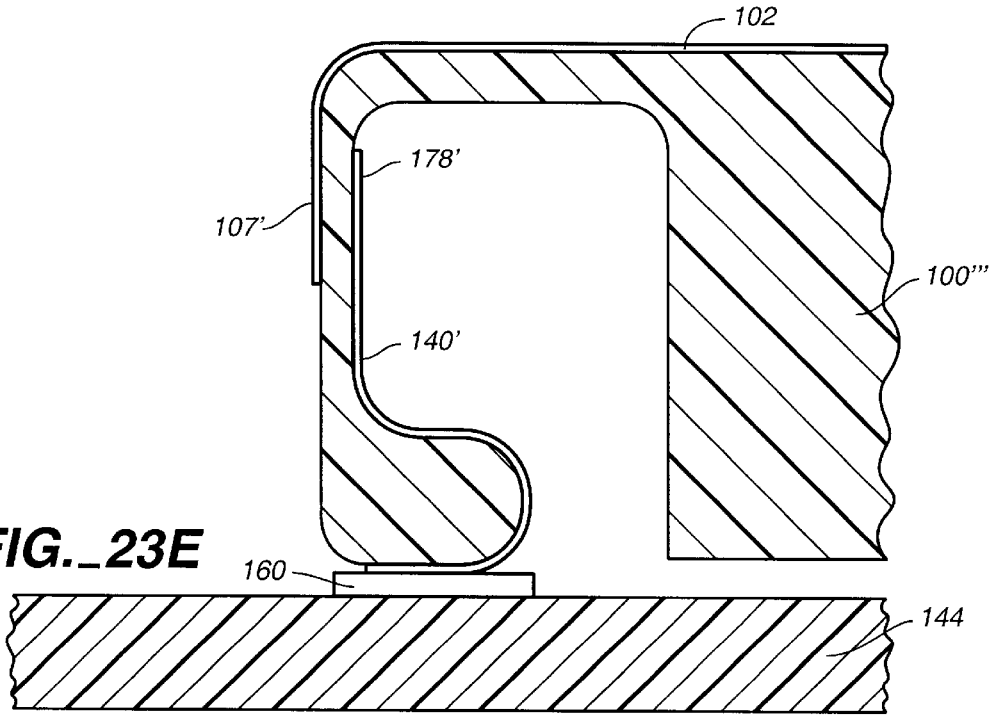
FIG. 23E is a partly cross-sectional side elevation view of one of the parallel plate capacitor regions having an alternative configuration.
Figure 24A:
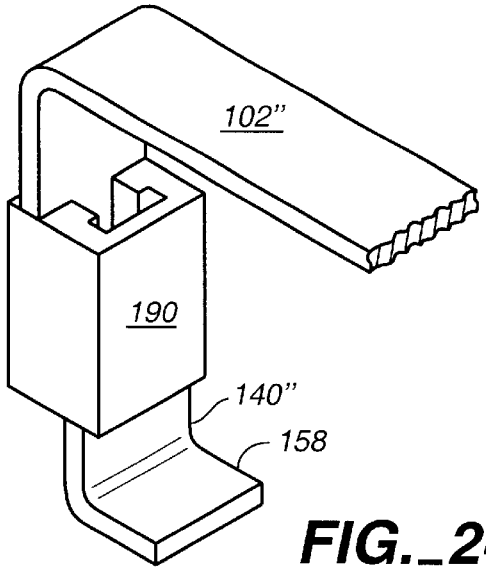
FIG. 24A is a perspective view showing the capacitor end of an element held in a precise alignment with respect to an other-capacitor-plate element by a molded dielectric element.
Figure 24B:
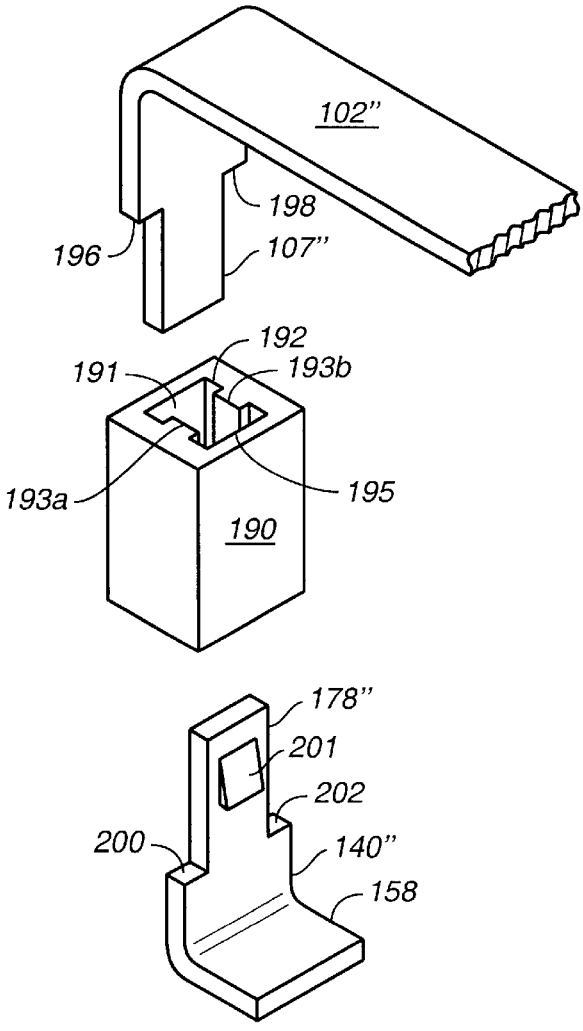
FIG. 24B is an exploded perspective view of the arrangement of FIG. 24A.

FIG. 23E is a partly cross-sectional side elevation view of one of the parallel plate capacitor regions in an arrangement in which the conductors are selectively plated on a molded base 100'" instead of using conductive pieces as in the embodiments just described. Selective molding techniques are known in the art. One suitable technique is known as "two shot molding". In a two shot molding process, a first, non-plateable layer is "shot" into the mold, followed by a second, selectively placed, plateable layer. In regions in which conductors are plated on the base, sharp edges must be avoided. Thus, in FIG. 23D, the second plate capacitor element 140' is plated on a downward extending region of the molding that, viewed as in FIG. 23E, has the shape of a lower case letter "b". The element has an upper portion 178' separated by molded base material that faces the downward extending plated region 107' of the driven element 102'.

Alternatively, the dielectric base (100, 100') can be omitted, while, at the same time, providing mechanical rigidity and precision capacitors. This alternative provides molded elements precisely holding the capacitor ends of elements 102 and 104. Thus, the antenna may be constructed in the manner of FIG. 10, but purposely omitting the dielectric base. Two variations of this alternative will be described—a first, described in connection with FIGS. 24A, 24B, 25A and 25B provides a two plate capacitor, whereas a second, described in connection with FIGS. 26A, 26B, 26C, 27A, 27B and 27C provides a three plate capacitor that allows further miniaturization.

Figure 25A:
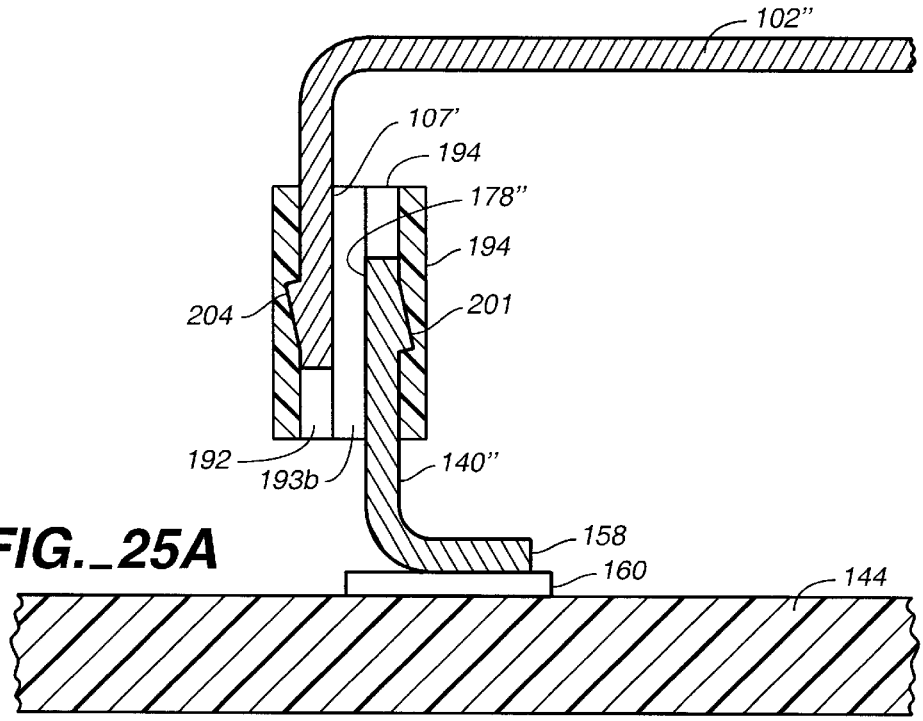
FIG. 25A is a cross-sectional side view of the arrangement of FIGS. 24A and 24B shown with a contact pad and ground plane.
Figure 25B:
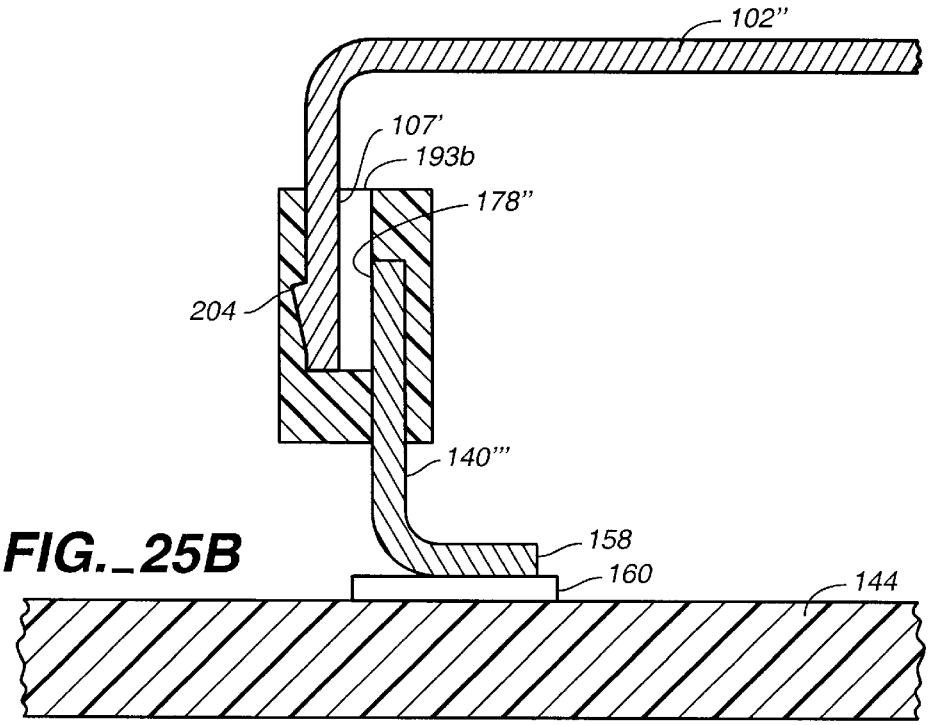
FIG. 25B is a cross-sectional side view of a variation of the arrangement of FIGS. 24A and 24B shown with a contact pad and a ground plane.

Turning to the first alternative, FIGS. 24A, 24B, 25A and 25B show the capacitor end of an element 102 held in a precise alignment with respect to an other-capacitor-plate element 140" by a molded dielectric element 190. This arrangement is equally applicable to the capacitor end of the other antenna element 104. The capacitor plate end portion 107' of a modified element 102" fits snuggly into a slot 192 defined by an inside wall 191 and ridges 193*a* and 193*b*. Portion 107' has an extending feature 204 (seen in FIG. 25A) for holding the end of element 102" in place once it is inserted into slot 192. The width of the end of element 102" is narrowed to create shoulders 196 and 198 in order that only a capacitor plate portion 107' extends into the molded element 190. Similarly, the width of the upward-extending end of capacitor element 140" is narrowed to create shoulders 200 and 202 in order that only a capacitor plate portion 178" extends into the molded element 190. Element 140" includes a folded-under portion 158 for electrically contacting a pad such as pad 160 (see FIGS. 25A and 25B). Portion 178' may have an extending feature 201 for holding it in place once it is inserted into slot 194. Slot 194 is defined by inside wall 195 and ridges 193*a* and 193*b*. FIG. 25A shows an alternative in which the two-capacitor forming elements are inserted into an already molded element 190. Alternatively, as shown in FIG. 25B, a modified element 140" ' (having no extending feature 178') is insert molded into element 190' and, subsequently, the end 107' of element 102" is inserted into element 190' and held by extending feature 204. In both cases, except for the dielectric material of ridges 193*a* and 193*b*, the gap between the capacitor-plate-forming elements is an air gap. As mentioned above, an air gap is preferred. The folded-under portions 158 of elements 140" and 140'" contact the contact pad 160, which may be, in turn, electrically connected to the ground plane 144. As another alternative, the elements may be reversed such that portion 107" is inserted into slot 194 and portion 178" (and 178'") is inserted into slot 192.

Figure 26A:
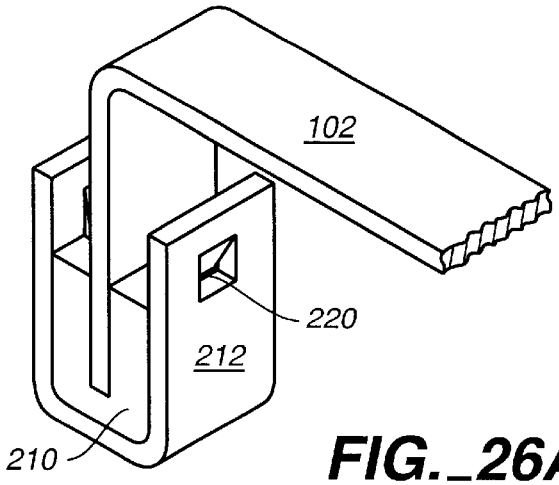
FIG. 26A is a perspective view showing the capacitor end of an element held in a precise alignment with respect to an other-capacitor-plate element by a molded dielectric element such that a three-plate capacitor is provided.
Figure 26B:
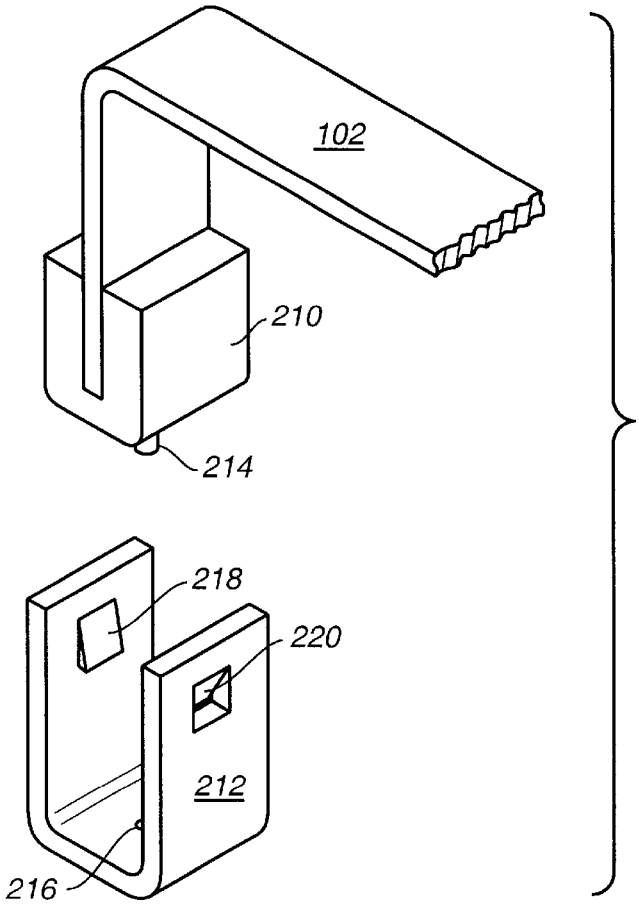
FIG. 26B is an exploded perspective view of the arrangement of FIG. 26A.
Figure 26C:
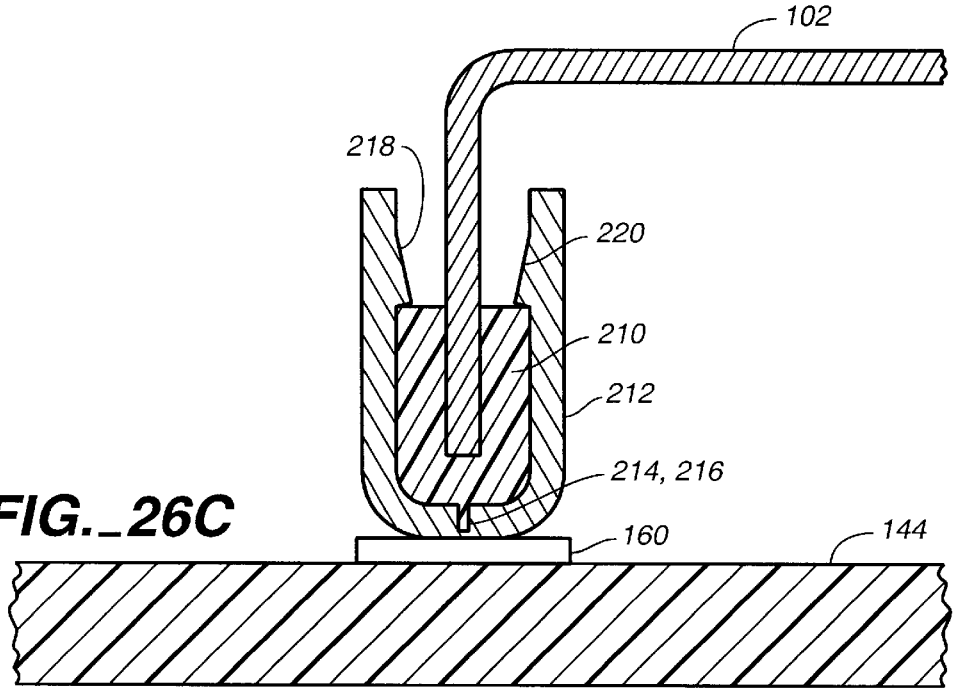
FIG. 26C is a cross-sectional side view of the arrangement of FIGS. 26A and 26B shown with a contact pad and a ground plane.

Turning now to the second alternative, FIGS. 26A, 26B, 26C, 27A, 27B and 27C show the capacitor end of an element 102 held by a molded dielectric element 210 in a precise alignment with respect to a U-shaped element 212 that forms a pair of capacitor-plates. Thus, a three-plate capacitor is provided, thereby yielding twice the capacitance provided by only two plates, thus reducing the area of the capacitor plates. This arrangement is equally applicable to the capacitor end of the other antenna element 104. Element 212 may be formed by various means, including extrusion, stamping, casting or machining. In a first variation, shown in FIGS. 26A, 26B and 26C, the capacitor end of element 102 is insert molded in a dielectric element 210 and element 210 has a downward extending locating feature such as a cylindrical rod that fits into a cylindrical receiving hole 216. The U-shaped element 212 preferably has two inward extending features 218 and 220 that hold the dielectric element 210 in place when it is inserted into the U-shaped element 212. As is best seen in FIG. 26C, only a portion of the gap between the capacitor plate portions of U-shaped element 212 and the end of element 102 is a solid dielectric, the other portion being air (the capacitor plate portions are those portions of the respective conductive elements that face each other). Preferably, the solid dielectric portion is minimized to the extent possible while maintaining satisfactory mechanical characteristics.

Figure 27C:
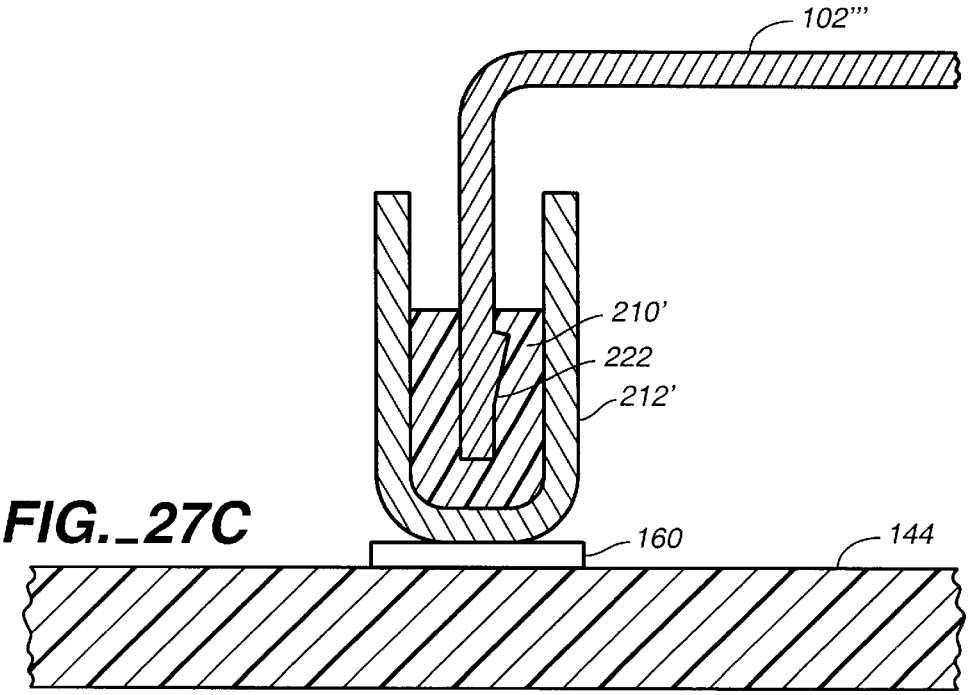
FIG. 27C is a cross-sectional side view of the arrangement of FIGS. 27A and 27B shown with a contact pad and a ground plane.
Figure 27A:
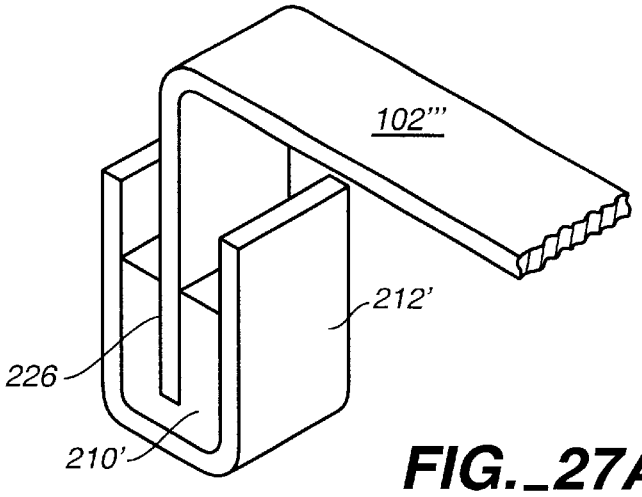
FIG. 27A is a perspective view showing a variation on the arrangement of FIGS. 26A–26C.
Figure 27B:
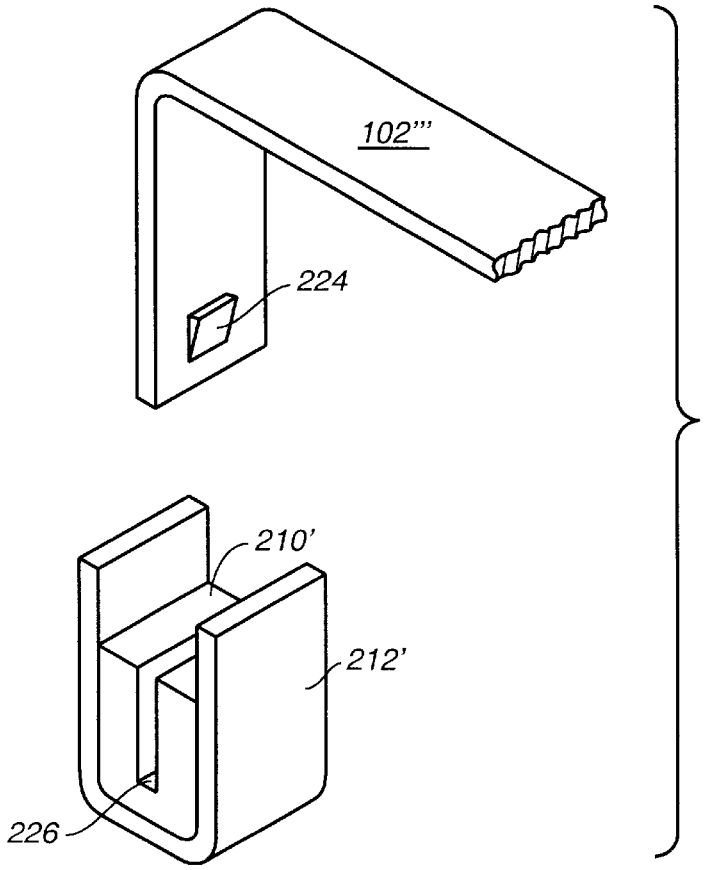
FIG. 27B is an exploded perspective view showing a variation on the arrangement of FIGS. 26A–26C.

FIGS. 27A, 27B and 27C show a variation on the three-plate configuration described in connection with FIGS. 26A, 26B and 26C. In this alternative, a dielectric 210' is inserted molded in a U-shaped element 212'. Subsequently, the capacitor-plate end of element 102'" is inserted into slot 226 in dielectric element 210' and is held securely in place by an extending feature 224.

During manufacturing, the portions 158 (FIGS. 25A, 25B), 212 (FIG. 26C) and 212' (FIG. 27C), which make electrical contact with contact pad 160, may be soldered, by reflow soldering or other-wise, to the contact pad prior to insertion of the respective driven element 102" (FIGS. 25A, 25B), 102 (FIG>26C) and 102" ' (FIG. 27C) into the respective molded dielectric element.

The various embodiments of the antennas of the present invention thus described provide one or more of the following qualities and benefits:

Simplicity and low cost;

realizability in a compact or an ultra-compact form;

capability of integration into portable WCD's such as cellular telephones, GPS (global positioning satellite) receivers, and data devices with minimum impact on the WCD's size;

usability in WCD's or in any wireless communications system;

a substantially hemispherical antenna pattern useful for signals from satellites or from any local direction;

at least two simultaneous polarizations;

simultaneous polarization diversity, which is useful in minimizing the negative effects of multipath;

a circular or elliptical polarization; and a peak gain in free space substantially comparable to a monopole or dipole.

It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

We claim:

1. An antenna for use at a particular frequency or in a frequency band including said particular frequency, comprising a conductive ground plane having a length in at least one dimension of about a quarter wavelength or more at said particular frequency, and first and second crossed conductive driven elements arrayed over at least a portion of said ground plane, wherein the elements in the region in which the elements cross are spaced apart so as to avoid electrical contact and any substantial capacitive coupling to each other, each element is about a quarter wavelength electrically at said particular frequency, each element has at least one end portion generally perpendicular to said ground plane and at least one further portion, said elements and ground plane generally defining a volume, at least one end of each driven element is electrically coupled to said ground plane, the elements are fed substantially ninety degrees out of phase with respect to each other, and wherein at least one end of at least one driven element is electrically coupled to said ground plane via a capacitor or said at least one driven element has a series capacitor within about the half of the element closest to said at least one end, whereby the physical length of said element is shorter than the electrical length of said element.

2. An antenna according to claim 1 wherein the further portion of at least one element has an end portion generally perpendicular to said ground plane and a portion between said end portions, the portion between said end portions being generally parallel to said ground, whereby said at least one element is generally U-shaped.

3. An antenna according to claim 1 wherein the further portion of at least one element slopes between said end portion and ground, whereby said at least one element is generally L-shaped.

4. An antenna according to claim 1 wherein at least one end of at least one driven element is electrically coupled to said ground plane via a capacitor.

5. An antenna according to claim 1 wherein at least one driven element has a series capacitor within the element.

6. An antenna according to claim 1 wherein the other end of said at least one driven element is electrically unattached and said electrically unattached end is directly fed.

7. An antenna according to claim 6 further comprising a matching network and wherein said unattached end is directly fed via said matching network.

8. An antenna according to claim 1 wherein the other end of said driven element is electrically coupled to said ground plane and said element is shun fed.

9. An antenna according to claim 8 further comprising a matching network and wherein said element is shunt fed via said matching network.

10. An antenna according to claim 1 wherein said driven elements cross at about ninety degrees.

11. An antenna according to claim 1 wherein said ground plane is substantially planar in the region over which said driven elements are arrayed.

12. An antenna according to claim 1 wherein said ground plane comprises a continuous conductor.

13. An antenna according to claim 1 wherein said ground plane comprises a discontinuous conductor.

14. An antenna according to claim 13 wherein said ground plane comprises a ground trace of a printed wiring board.

15. An antenna according to any one of the claims 1 and 6–14 further comprising a dielectric base, at least a portion of which is within at least some of the volume between said driven elements and said ground plane.

16. An antenna according to claim 15 wherein said dielectric base provides mechanical support to said driven elements.

17. An antenna according to claim 16 wherein said dielectric base is formed from a moldable dielectric material.

18. An antenna according to any one of the claims 1 and 6–14 further comprising at least one dielectric member and at least one conductive capacitor plate element, wherein said dielectric member holds at least a portion of said at least one driven element and at least a portion of said conductive capacitor plate element with respect to each other, whereby a portion of the end of said element and a portion of said conductive capacitor plate element form spaced-apart plates of said capacitor.

19. An antenna according to claim 18 wherein said conductive capacitor plate element comprises a further portion of said at least one driven element.

20. An antenna according to claim 18 wherein at least a portion of said dielectric member is in the gap between at least a portion of said spaced-apart plates.

21. An antenna according to claim 20 wherein at least a portion of said gap is an air gap.

22. An antenna according to claim 18 wherein said capacitor has two plates.

23. An antenna according to claim 18 wherein said capacitor has three plates.

24. An antenna according to claim 18 wherein said dielectric member is formed from a moldable dielectric material.

25. An antenna according to claim 24 wherein at least the portion of said element or at least the portion of said conductive capacitor plate element that forms one of the plates of said capacitor is comprised of a conductive material that is inserted into the dielectric member after the dielectric member is molded.

26. An antenna according to claim 24 wherein at least the portion of said element or at least the portion of said conductive capacitor plate element that forms one of the plates of said capacitor is comprised of a conductive material that is insert molded into the dielectric member.

27. An antenna according to claim 24 wherein at least the portion of said element or at least the portion of said conductive capacitor plate element that forms one of the plates of said capacitor is comprised of a conductive material that is plated onto the dielectric member.

28. An antenna according to claim 18 wherein said at least one dielectric member comprises a dielectric base, said base filling at least a portion of the volume between said driven elements and said ground plane.

29. An antenna according to claim 28 wherein said dielectric base provides mechanical support to said driven elements.

30. An antenna component, comprising a conductive antenna element, a capacitor electrically coupled to said element, the capacitor having plates and a dielectric between the plates, wherein at least one of the plates of said capacitor comprises at least a portion of at least a segment of said conductive antenna element, and a conductive member, at least a portion thereof comprising at least one other plate of said capacitor, wherein the capacitor dielectric includes at least in part a moldable dielectric shaped to hold the plates of the capacitor with respect to each other.

31. An antenna component according to claim 30 wherein said conductive member comprises a further segment of said conductive antenna element.

32. An antenna component according to claim 31 further comprising a conductive ground plane, wherein said conductive member is electrically coupled to said ground plane.

33. An antenna component according to claim 30 or 31 wherein the capacitor dielectric includes air.

34. An antenna component according to claim 30 or 31 wherein the capacitor has three plates, one of said plates comprising said at least a portion of at least a segment of said conductive antenna element and said second and third plates comprising said at least a portion of said conductive member formed generally in a U-shape so as to present two generally parallel surfaces between which said portion of said at least a portion of at least a segment of said conductive antenna element is held by said dielectric.

35. An antenna component according to claim 30 or 31 wherein the capacitor has three plates, one of said plates comprising said at least a portion of said conductive member and said second and third plates comprising said at least a portion of at least a segment of said conductive antenna element formed generally in a U-shape so as to present two generally parallel surfaces between which said portion of said at least a portion of said conductive member is held by said dielectric.

36. An antenna component according to claim 30 wherein the capacitor has two plates.

37. An antenna component according to claim 30 wherein at least the portion of at least a segment of said conductive antenna element or at least said portion of said conductive member that forms one of the plates of said capacitor is comprised of a conductive material that is added to the dielectric after the dielectric is molded.

38. An antenna according to claim 30 wherein at least the portion of at least a segment of said conductive antenna element or at least said portion of said conductive member that forms one of the plates of said capacitor is comprised of a conductive material that is insert molded into the dielectric.

39. An antenna according to claim 30 wherein at least the portion of at least a segment of said conductive antenna element or at least said portion of said conductive member that forms one of the plates of said capacitor is comprised of a conductive material that is plated onto the dielectric.

* * * * *